US006423476B1

(12) United States Patent
Yun

(10) Patent No.: US 6,423,476 B1
(45) Date of Patent: Jul. 23, 2002

(54) METHOD OF MANUFACTURING A NOZZLE PLATE

(75) Inventor: Sang Kyeong Yun, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/596,145

(22) Filed: Jun. 16, 2000

(30) Foreign Application Priority Data

Dec. 22, 1999 (KR) ..... 99-60087

(51) Int. Cl.[7] ..... B41J 2/16
(52) U.S. Cl. ..... 430/320; 347/47
(58) Field of Search ..... 430/320; 347/47

(56) References Cited

U.S. PATENT DOCUMENTS 3,921,916 A * 11/1975 Bassous ..... 239/601
4,106,976 A * 8/1978 Chiuo et al. ..... 156/644

* cited by examiner

*Primary Examiner*—John A. McPherson

(74) *Attorney, Agent, or Firm*—Ladas & Parry

(57) ABSTRACT

A method for manufacturing nozzle plate and produced nozzle plate thereby are disclosed which method is either sequence that comprises a step to provide silicon wafer; a step to form straight pipe part layer under the silicon wafer by doping impurity component, electroplating a metal or forming a polysilicon layer; a step to form crater layer under the straight pipe part layer by electroplating a metal; a step to form nozzle slope part by anisotropic etching after patterning the silicon wafer; a step to form straight pipe part of nozzle outlet part at the straight pipe part layer by dry etching of the straight pipe part layer; and a step to form crater at the crater layer by etching after patterning the crater layer or sequence that comprises a step to provide silicon wafer; a step to form straight pipe part layer under the silicon wafer by doping impurity component, electroplating a metal or forming a polysilicon layer; a step to form nozzle slope part by anisotropic etching after patterning the silicon wafer; a step to form straight pipe part of nozzle outlet part at the straight pipe part layer by dry etching of the straight pipe part layer; a step to form photoresist layer under the straight pipe part layer; a step to leave photoresist only at crater part by patterning the photoresist layer; a step to form crater layer by electroplating a metal under the straight pipe part layer; and a step to form crater by removing photoresist.

59 Claims, 32 Drawing Sheets

METHOD OF MANUFACTURING A NOZZLE PLATE

BACKGROUND OF THE INVENTION

1. Field of the Invention

Present invention relates to nozzle plate for ink jet printer head and particularly relates to a method of manufacturing nozzle plate for ink jet printer head using the silicon process and a nozzle plate manufactured thereby.

2. Description of the Prior Art

In ink jet printer head, ink contained in ink supply unit is supplied to the writing unit through ink supply pipe and the writing unit executes printing by jetting ink provided from ink supply unit into material where to be written. Whence ink is sprayed through nozzle formed at nozzle plate onto material where to be written.

It is important to make the jetted inkdrop sizes to be fine and uniform in order to improve printing characteristics; for which purpose of fine and uniform size, the nozzle outlet part diameter must be formed fine and uniform.

By the way, meniscus exposed to atmosphere at nozzle outlet part arouses vibration owing to inertial flow of ink to refill the jetted ink quantity after ink jetting during which meniscus vibration the ink cannot be jetted out. Therefore it is important to quickly attenuate meniscus vibration and stabilize it in order to reduce interval unto next ink jet. Printer head jet frequency could be enhanced if meniscus vibration could be quickly reduced.

Method of reinforcing the attenuation function by reducing the nozzle outlet part diameter formed at nozzle plate is used as a means for quickly attenuating the meniscus vibration.

Thus in ink jet printer head, the nozzle outlet part formed at nozzle plate is important factor influencing the inkdrop jet performance, the stability after ink jetting and the printing characteristics.

Conventionally it was made that nozzle plate outlet part cross-section shape has straight pipe portion of suitable length to reduce nozzle plate outlet part diameter.

Nozzle plate having suitable length of straight pipe portion at nozzle outlet part can quickly attenuate meniscus vibration because the portion diameter is relatively smaller than at other portions.

As for nozzle plate having suitable length of straight pipe portion at outlet part, straight line movability of ink is improved because ink flowing through nozzle plate outlet forms a laminar flow at the straight pipe equivalent portion when ink is jetted from where printer head has been constructed by assembling channel, chamber, actuator etc. above the said nozzle plate. Therefore precision or dispersion at position where inkdrop lands on the material on which to be written will be improved so that print status will be improved.

Usually metal has been used for nozzle plate material and the method of electroforming and the method of micropunching and polishing process have been used to make the nozzle plate using a metal.

In method of electroforming process, photoresist is thin coated on substrate and then it is patterned. Electroplating material grows when electric current flows after substrate where pattern has been formed is immersed in electrolyte after which the electroplating is stopped if electroplating material has grown to size of nozzle to be used. Nozzle plate where nozzle has been formed is completed by removing (photoresist that is formed on) substrate after finishing the electroplating.

Method of forming the nozzle plate by electroforming process has advantage that the manufacturing process is simple and mass production is feasible. But there are problems that it is difficult to form a straight pipe portion at outlet part of nozzle because cross sectional shape of formed nozzle has natural arc type and that bond stability is decreassed because nozzle plate area is decreased which is bonded at printer head when nozzle plate is to be bonded at printer head.

In method of making the nozzle plate by micropunching and polishing processes, metal sheet to be used as nozzle plate is drawn by micropunching pin so that nozzle cross section face is formed beyond depth of opposite surface of the metal sheet. Protruded part of metal sheet after drawing process is removed by polishing process and burr generated on metal sheet by polishing process is removed by electrolytic polishing or chemical polishing.

This method has advantage that cross sectional shape of nozzle may be made at will according to punching pin used and that it is easy to make straight pipe portion at nozzle outlet part. Also it has advantage that when nozzle plate is bonded at printer head the bonding area will be wide so that it will have high stability.

But it has problems that its work processes are complicated as it must go through polishing process to remove protruded part after micropunching, burr generated by this polishing process must be removed by successive polishing processes such as electrolytic polishing or chemical polishing, etc. so that also it needs large scalefacility. And it has problem that production cost rises because there are much micropunching pin damages according to punching duration so that its durable life is short.

In case when nozzle plate is fabricated using metal as above, water repellency treatment should be done on nozzle plate surface and nozzle contacting the ink.

Next in method of fabricating nozzle plate using a laser, polymer such as polyimide is used for nozzle plate material. Nozzle is fabricated in fine pattern by irradiating laser for short time using hot laser on nozzle plate made of polymer.

This method has advantage that polymer itself has water repellency effect so that separate water repellency treatment is not needed but it has problems that yield percentage is low and it is expensive for mechanism when laser is irradiated onto large area. Nozzle plate may be fabricated using monocrystalline silicon instead of metal for a continuous type ink jet head and an ink jet head applying thermal expansion of film or bubble jet.

Anisotropic etching process of silicon among bulk micromachining technique is used if nozzle plate is fabricated using monocrystalline silicon stuff.

Nozzle is fabricated by forming pyramid type hole in silicon substrate of (100) crystal direction using anisotropic etching liquid after shielding other parts than that to be etched, by silicon oxide film or silicon nitride film. Whence shapes of nozzle edge and nozzle cavity are controlled by etching liquid used in etching, etching time and etching rate of silicon.

Nozzle fabricated by this method has problems that straightness is degraded at ink jet and, in case when nozzle is fabricated by isotropic etching after anisotropic etching, degree of etching of each part becomes different from according as etching is repeated so that fabricated nozzles are not uniform.

SUMMARY OF THE INVENTION

Purposes of present invention to solve the above problems are to provide fabrication method of nozzle plate where crater and nozzle having straight pipe part using silicon process and silicon wafer stuff and to provide nozzle plate fabricated thereby.

Present invention to achieve the above purposes relates nozzle plate fabrication method comprising a step to provide silicon wafer; a step to form straight pipe part layer under the silicon wafer by doping impurity component, electroplating a metal or forming a polysilicon layer; a step to form crater layer under the straight pipe part layer by electroplating a metal; a step to form nozzle slope part by an isotropic etching after patterning the silicon wafer; a step to form straight pipe part of nozzle outlet part at the straight pipe part layer by dry etching of the straight pipe part layer; and a step to form crater at the crater layer by etching after patterning the crater layer.

And the invention relates nozzle plate fabrication method comprising a step to provide silicon wafer; a step to form straight pipe part layer under the silicon wafer by doping impurity component, electroplating a metal or forming a polysilicon layer; a step to form nozzle slope part by anisotropic etching after patterning the silicon wafer; a step to form straight pipe part of nozzle outlet part at the straight pipe part layer by dry etching of the straight pipe part layer; a step to form photoresist layer under the straight pipe part layer; a step to leave photoresist only at crater part by patterning the photoresist layer; a step to form crater layer by electroplating a metal under the straight pipe part layer; and a step to form crater by removing photoresist.

And the invention relates nozzle plate comprising silicon wafer; straight pipe part layer made of polysilicon, metal or a doping layer formed under the silicon wafer; crater layer formed under the straight pipe part layer by electroplating a metal; nozzle slope part formed at the silicon wafer by anisotropic etching; straight pipe part of nozzle outlet part formed at the straight pipe part layer by dry etching of the straight pipe part layer; and crater formed at the crater layer by etching the crater layer.

DETAILED DESCRIPTION

Figure 1:
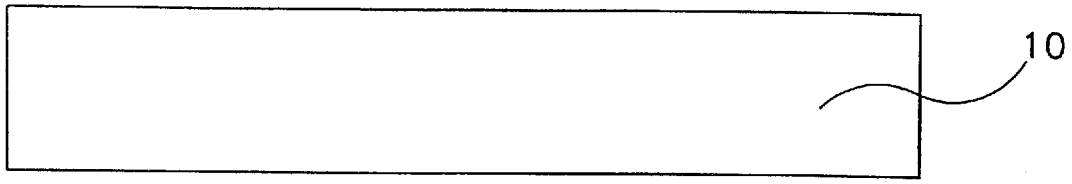
FIG. 1 through FIG. 9 are flow diagrams showing a practice example of the present invention.
Figure 2:
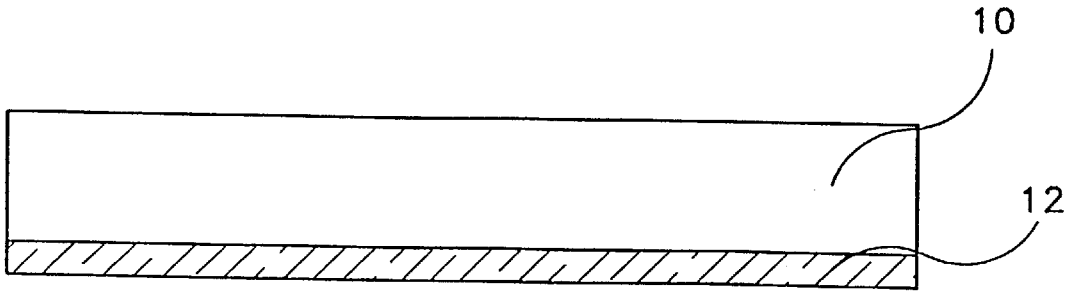
Figure 3:
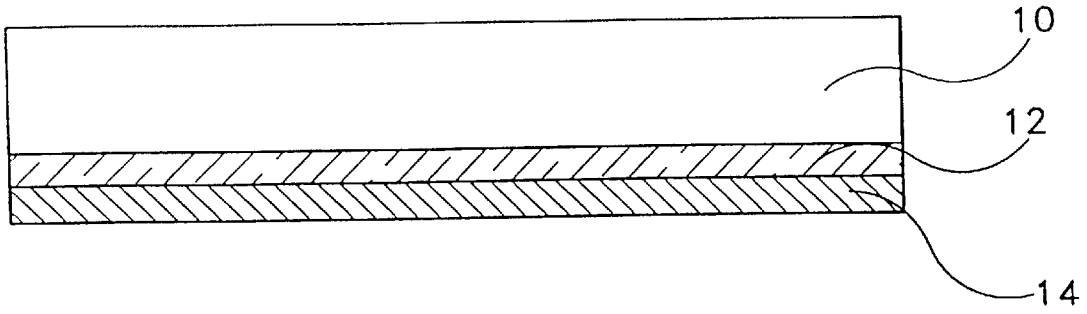
Figure 4:
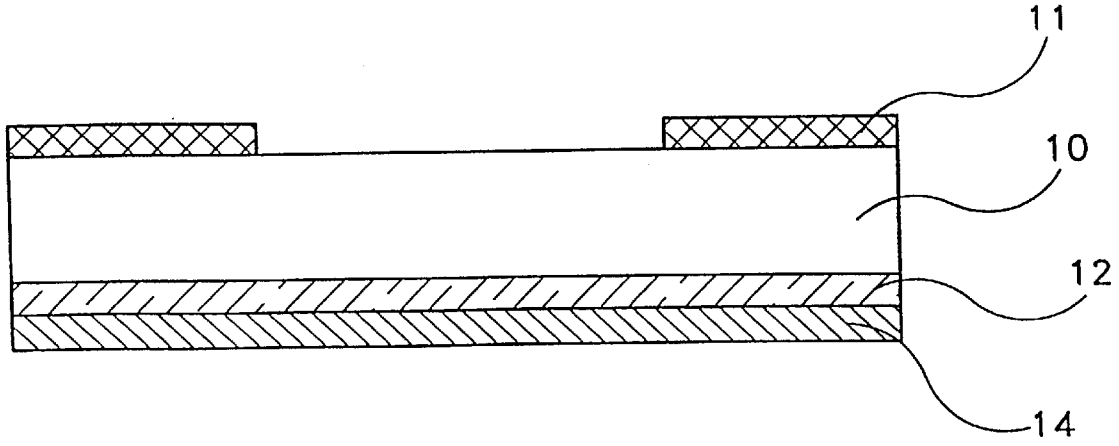
Figure 5:
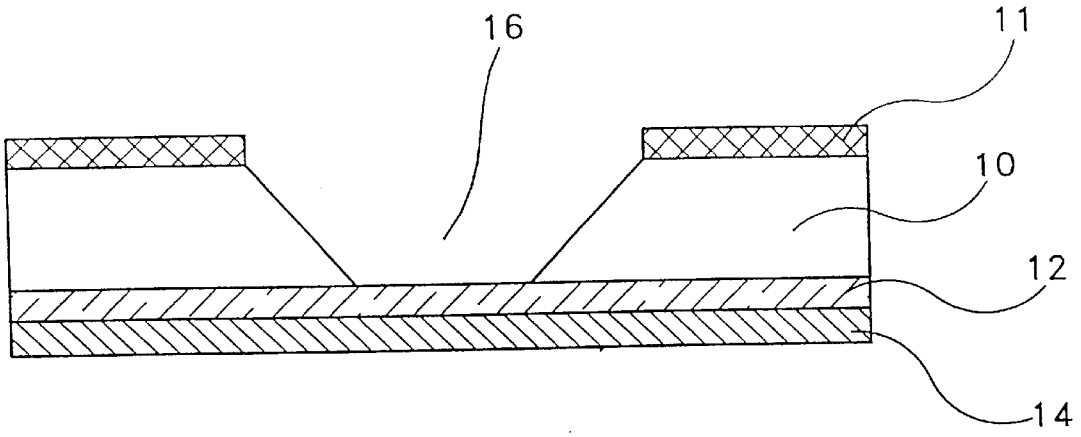
Figure 6:
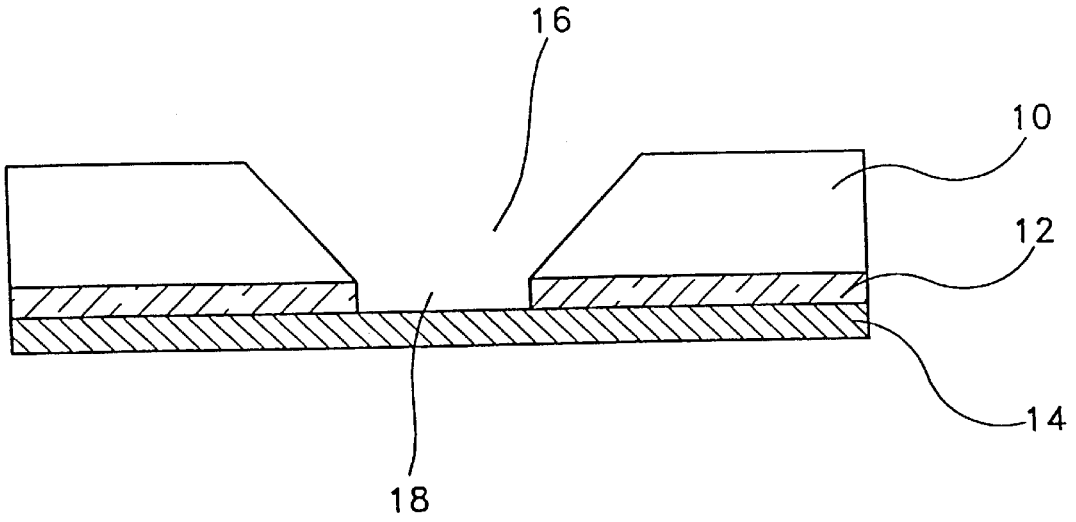
Figure 7:
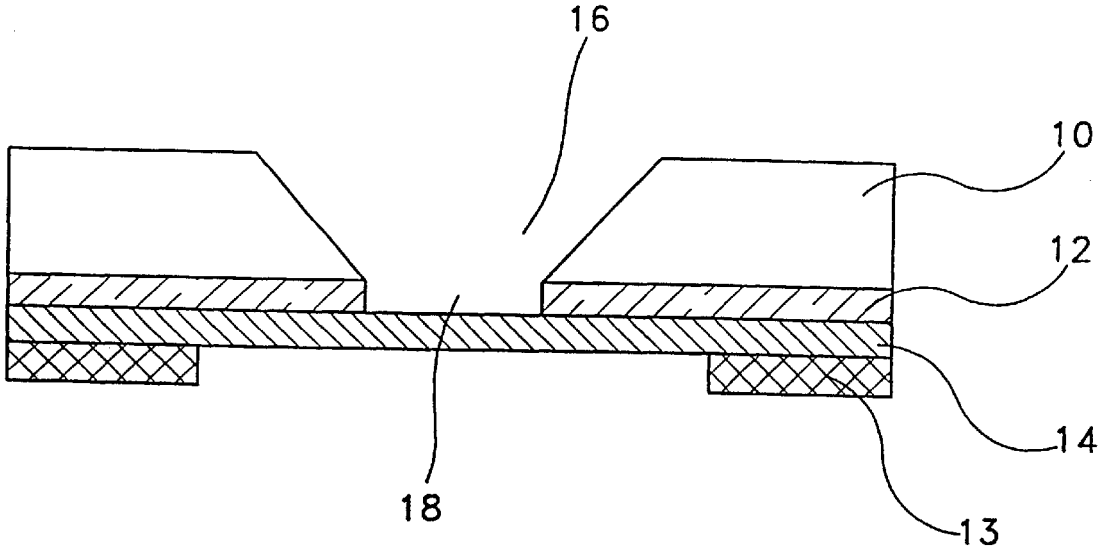
Figure 8:
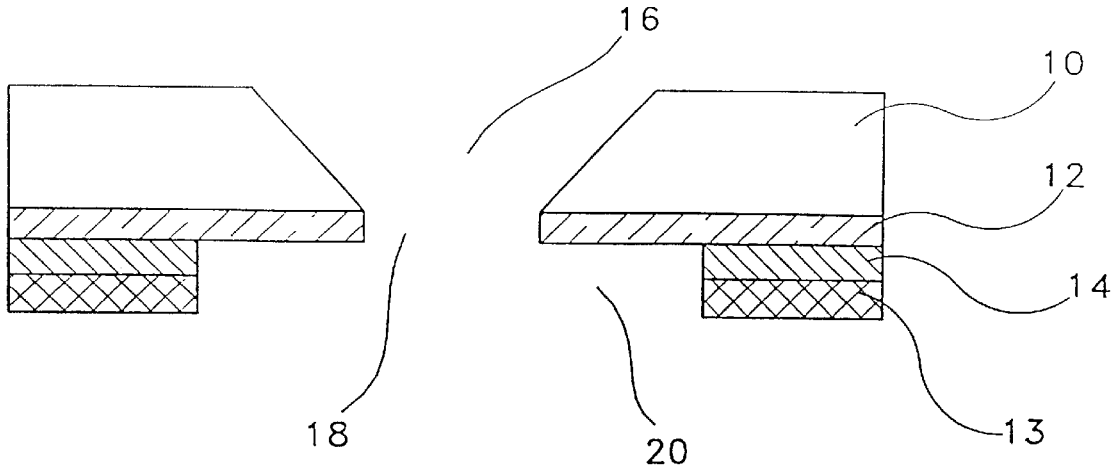
Figure 9:
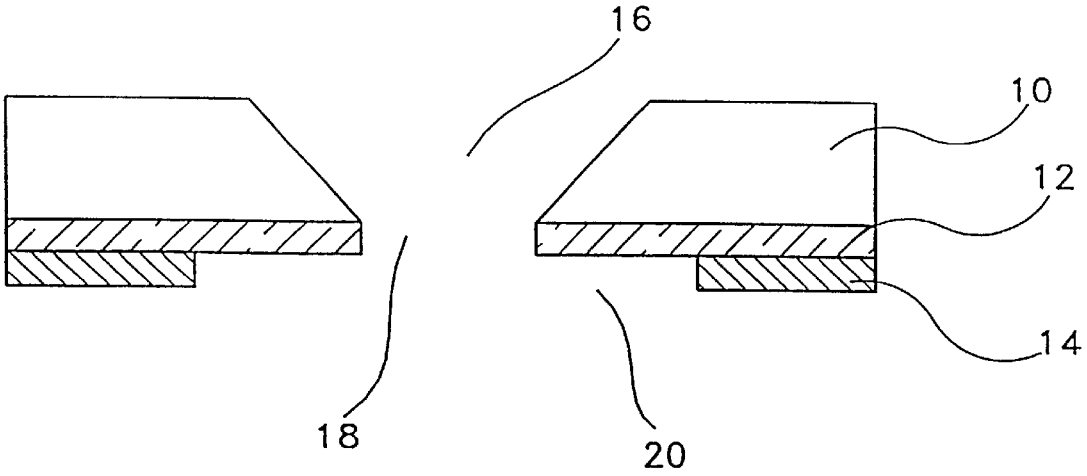
Figure 10:
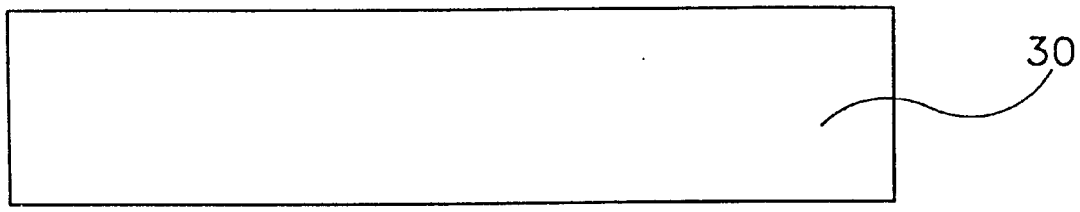
FIG. 10 through FIG. 18 are flow diagrams showing other practice example of the present invention.
Figure 11:
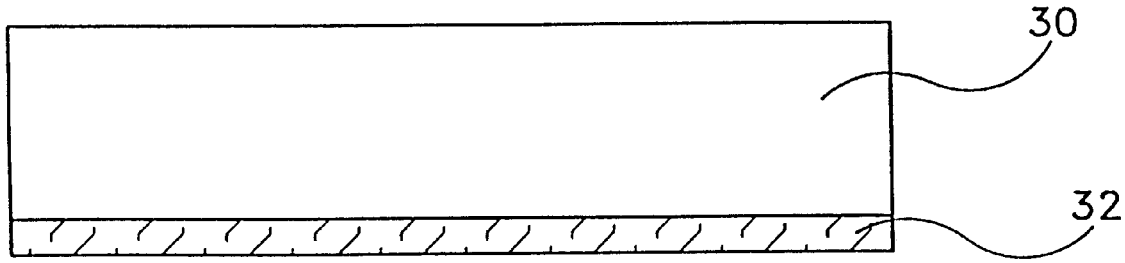
Figure 12:
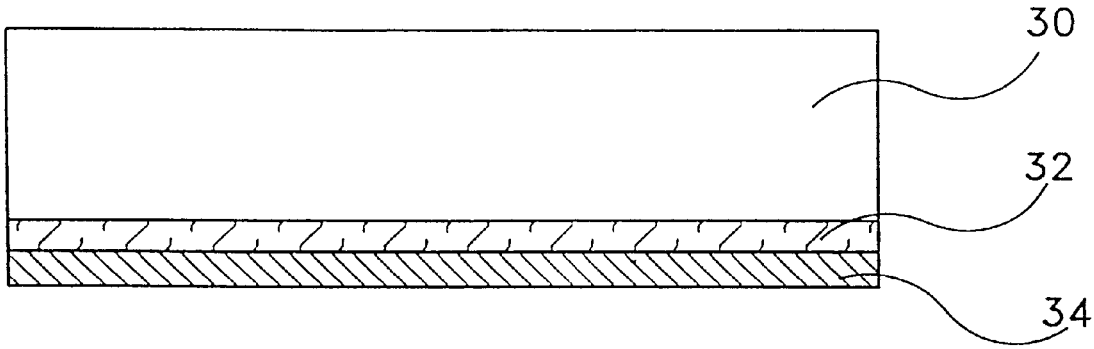
Figure 13:
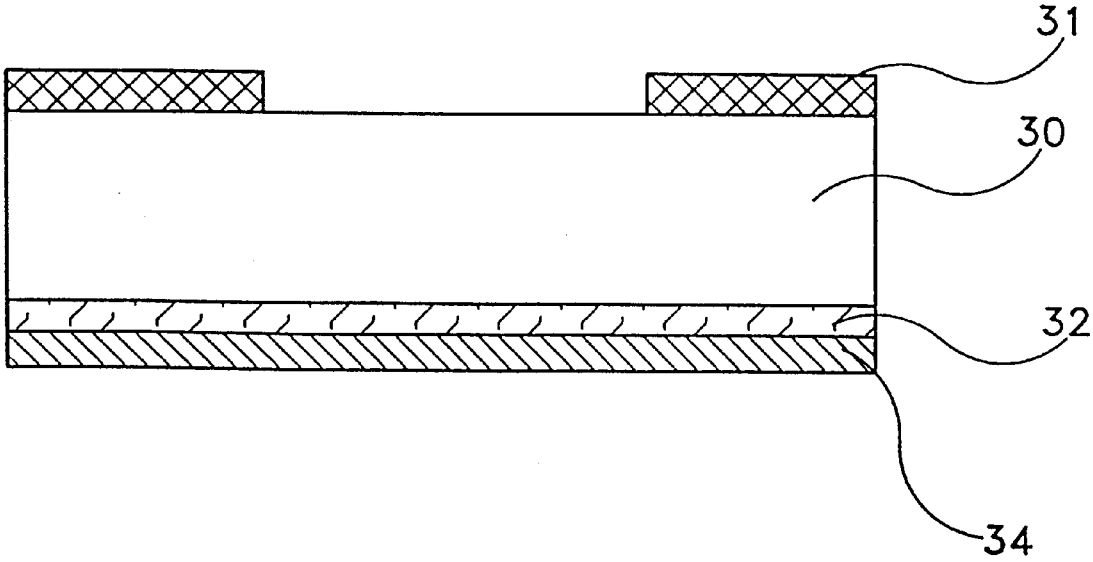
Figure 14:
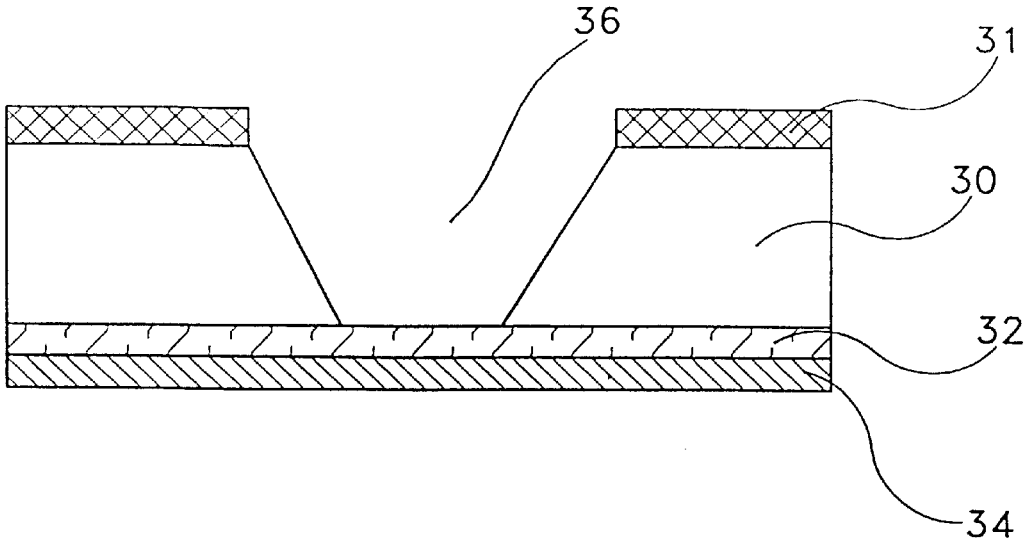
Figure 15:
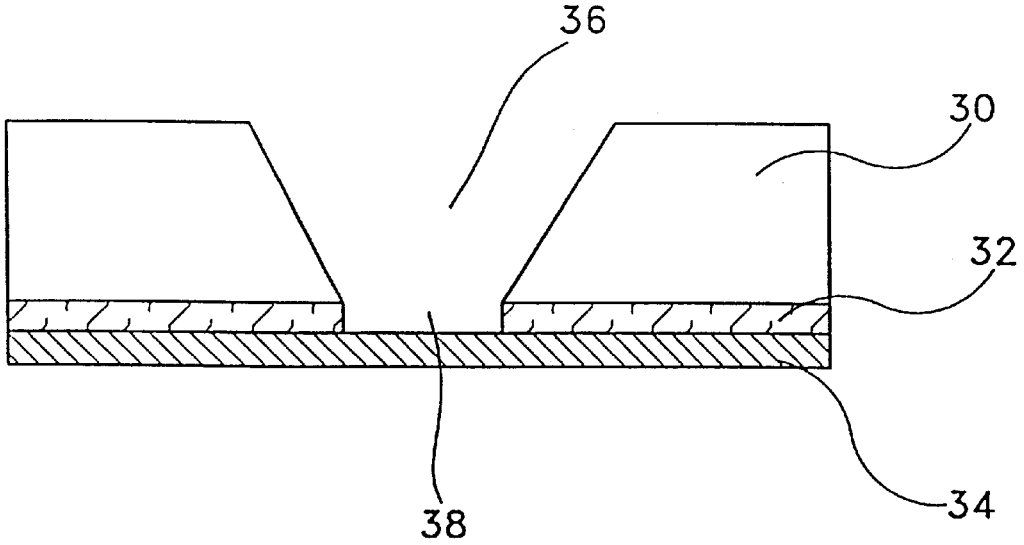
Figure 16:
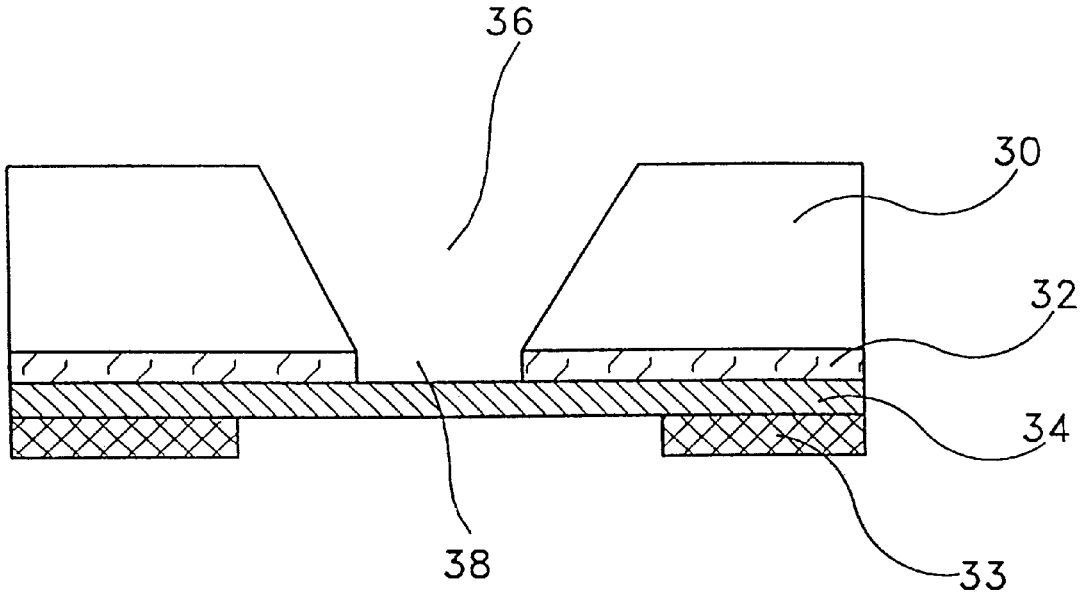
Figure 17:
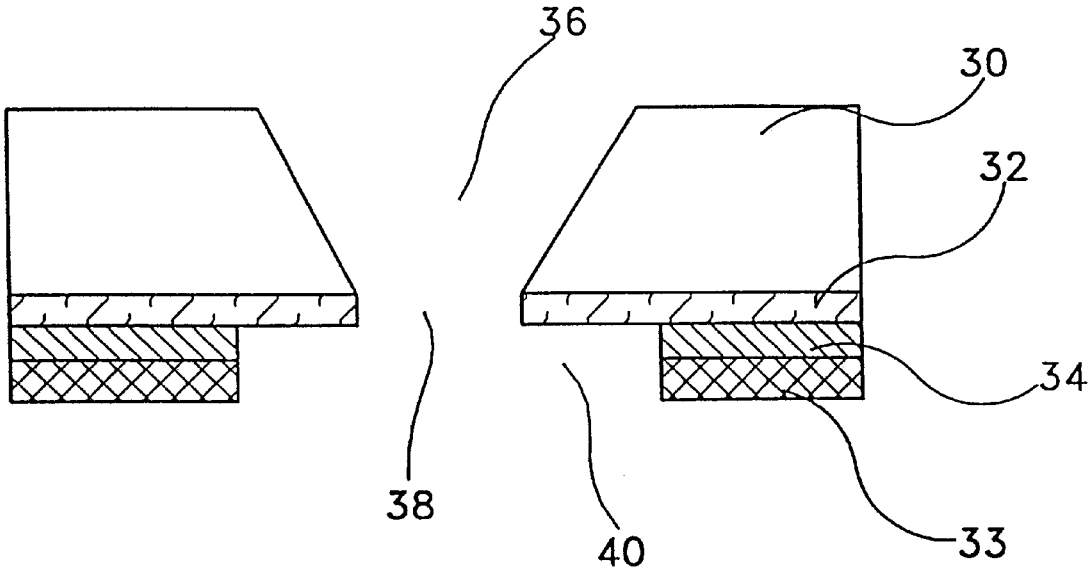
Figure 18:
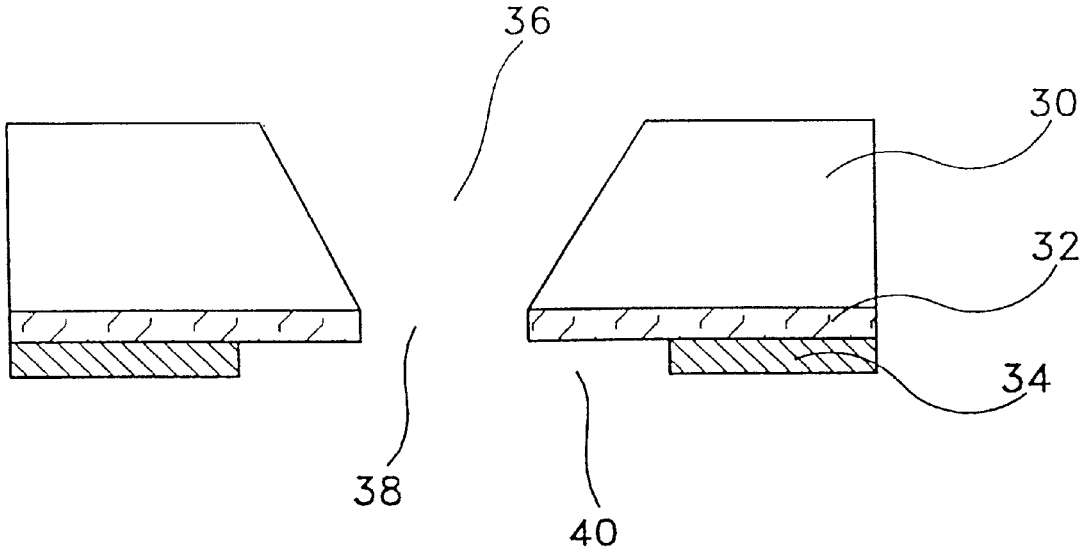
Figure 19:
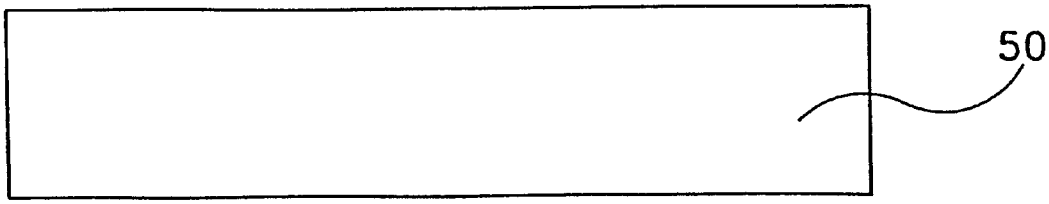
FIG. 19 through FIG. 27 are flow diagrams showing another practice example of the present invention.
Figure 20:
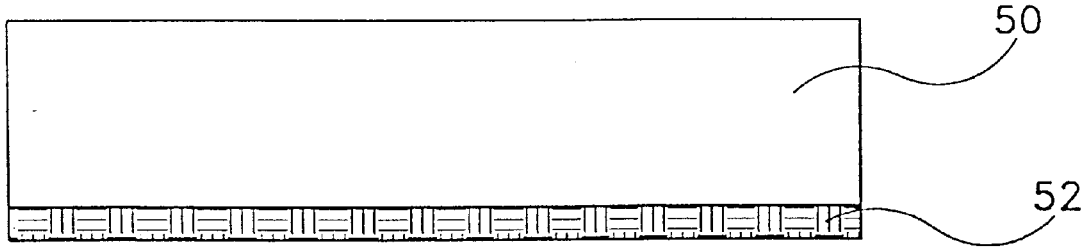
Figure 21:
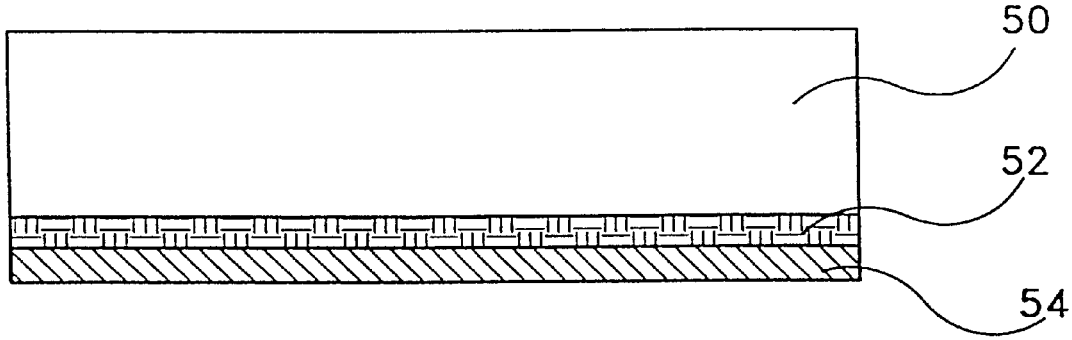
Figure 22:
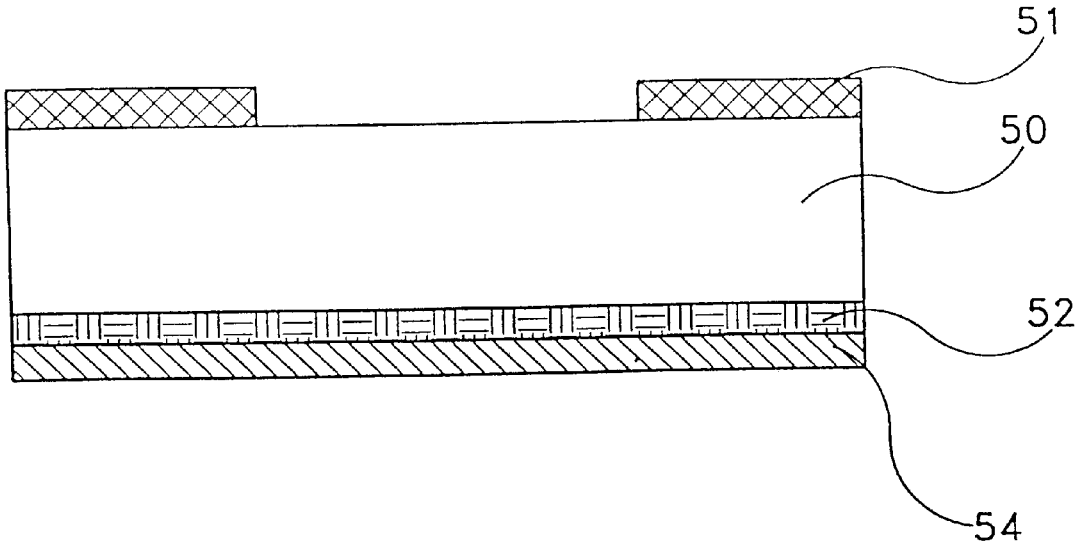
Figure 23:
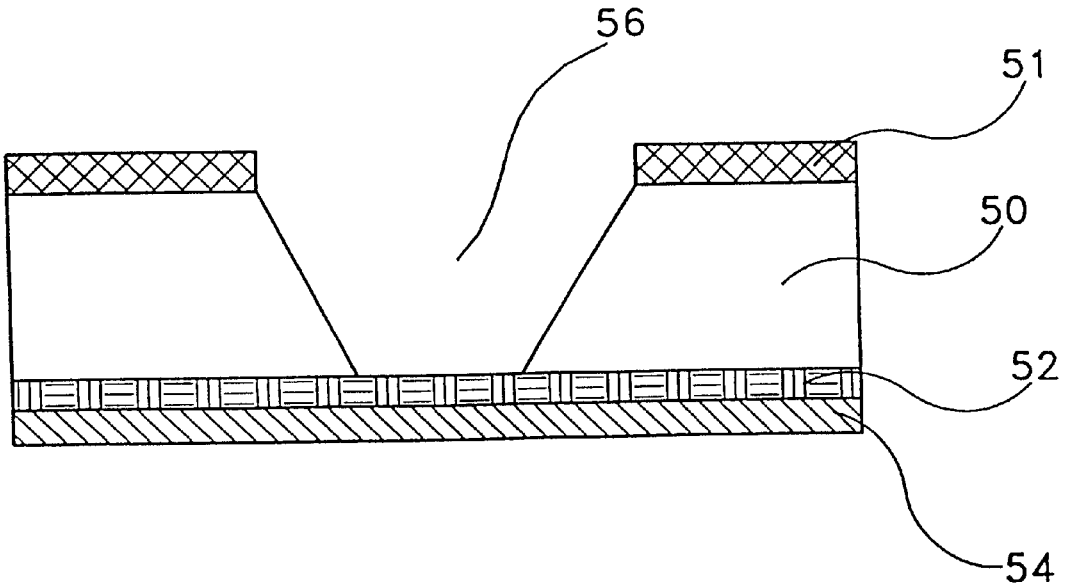
Figure 24:
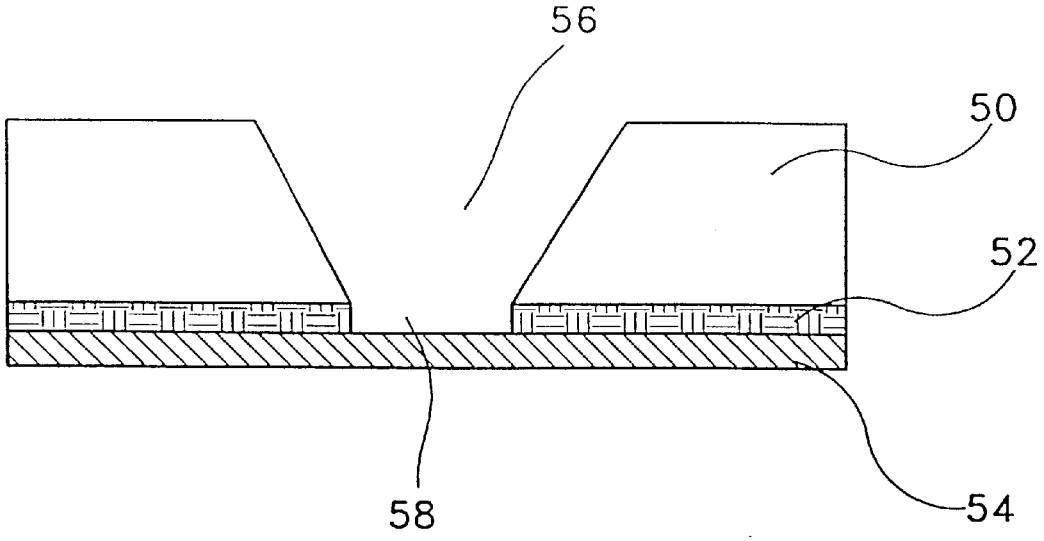
Figure 25:
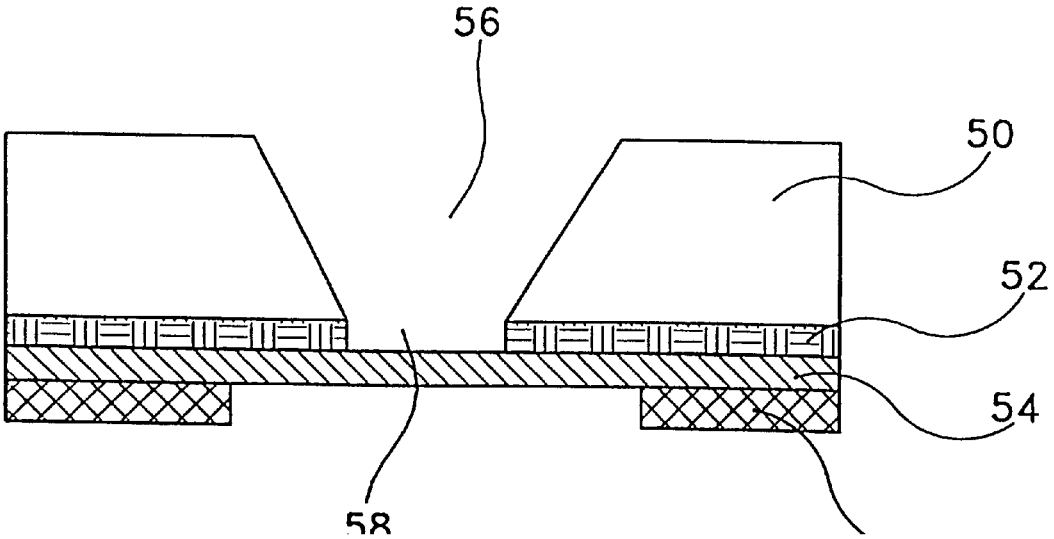
Figure 26:
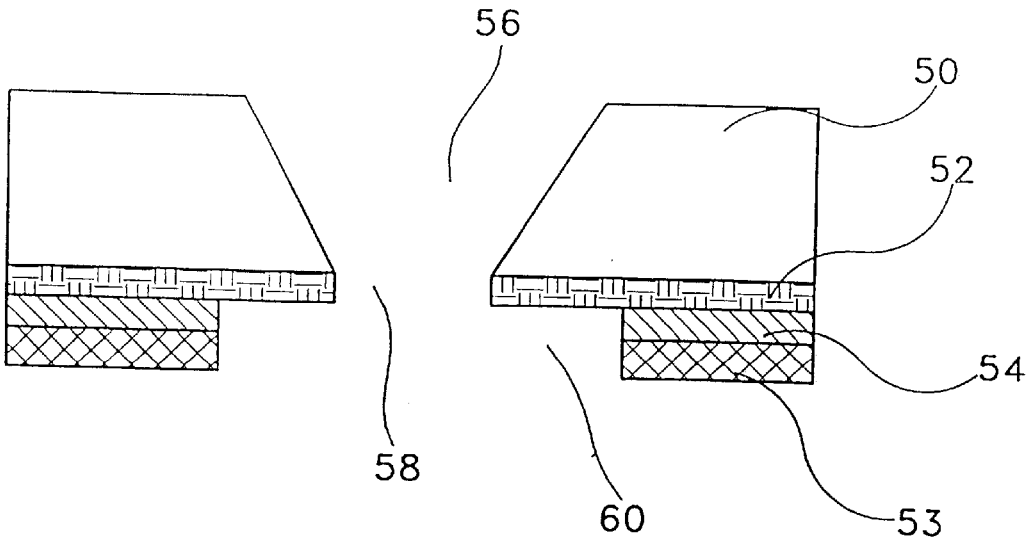
Figure 27:
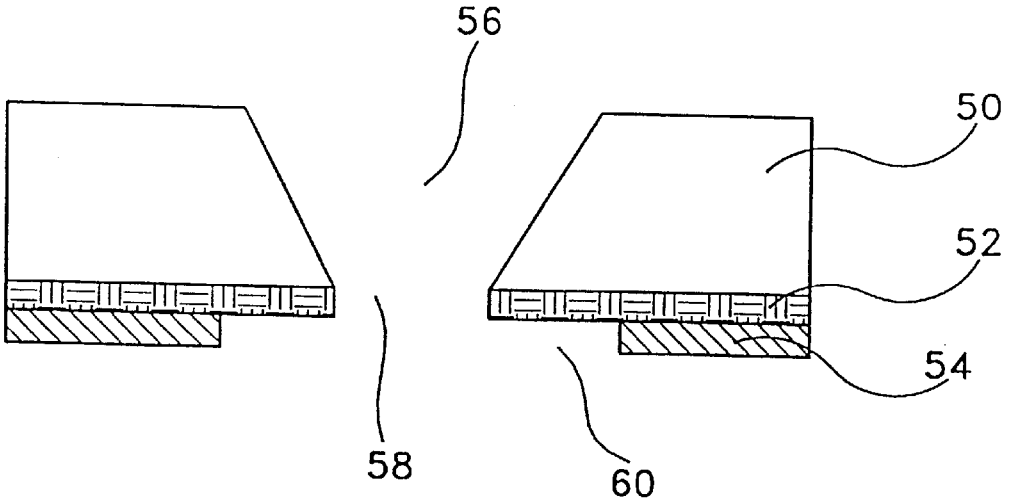
Figure 28:
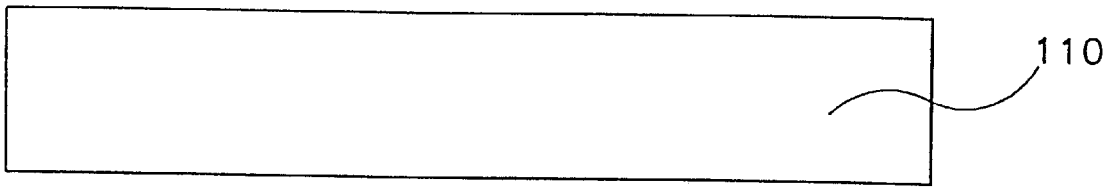
FIG. 28 through FIG. 36 are flow diagrams showing more another practice example of the present invention.
Figure 29:
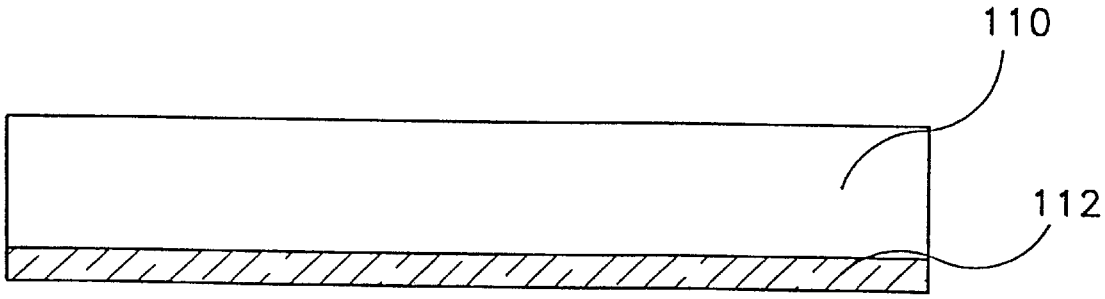
Figure 30:
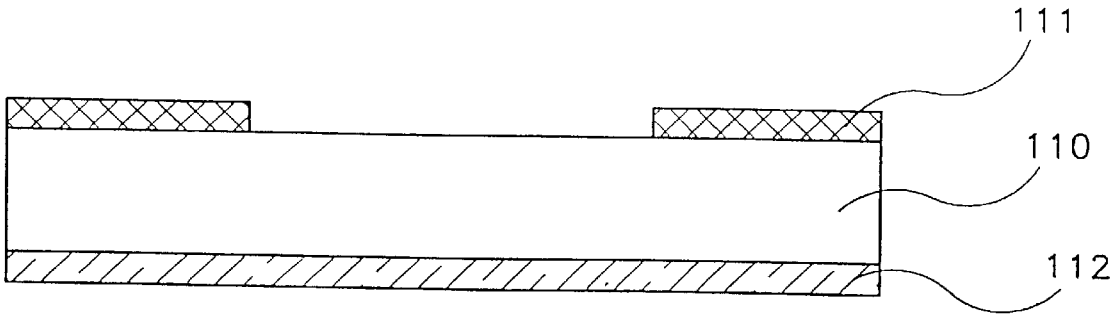
Figure 31:
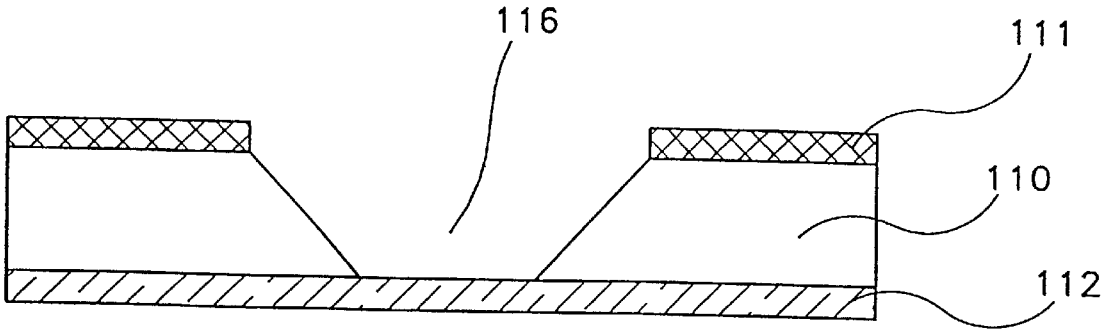
Figure 32:
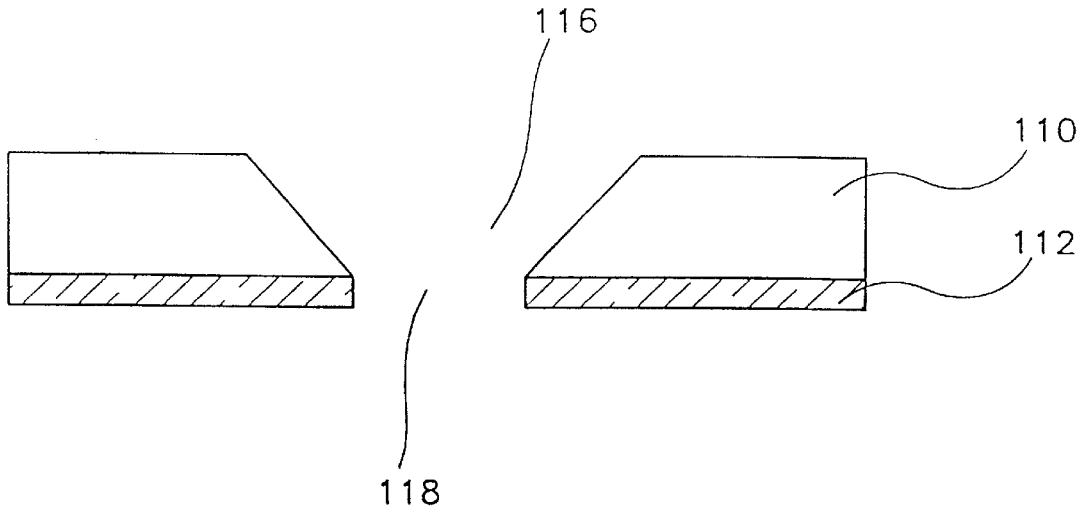
Figure 33:
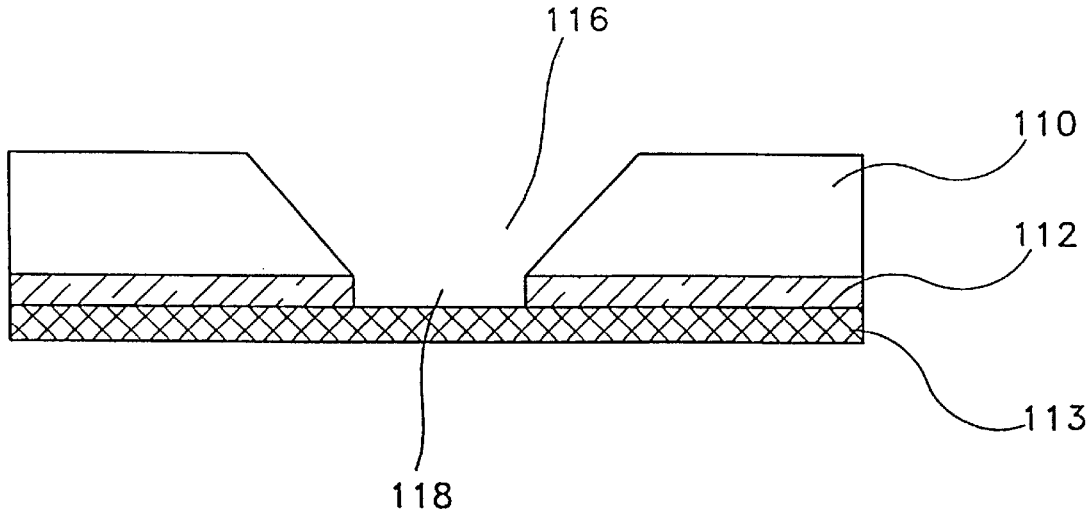
Figure 34:
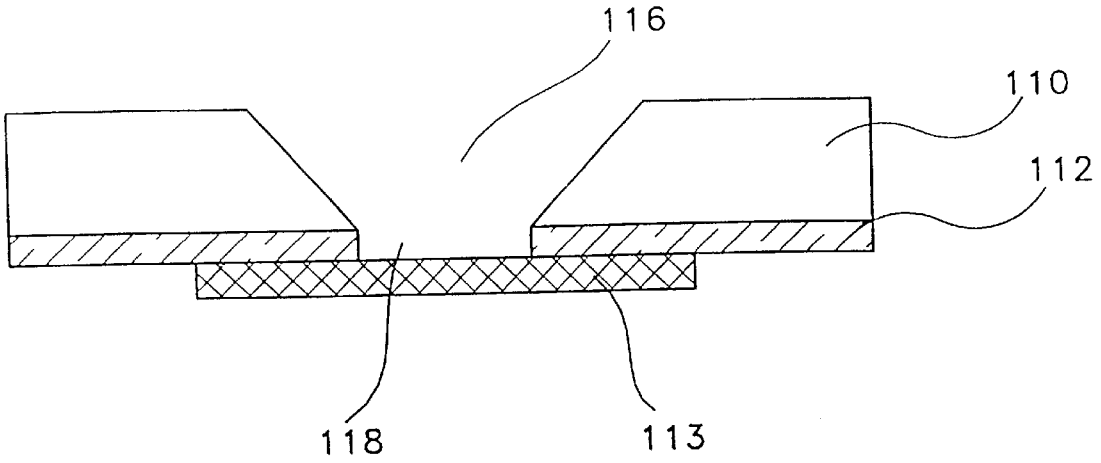
Figure 35:
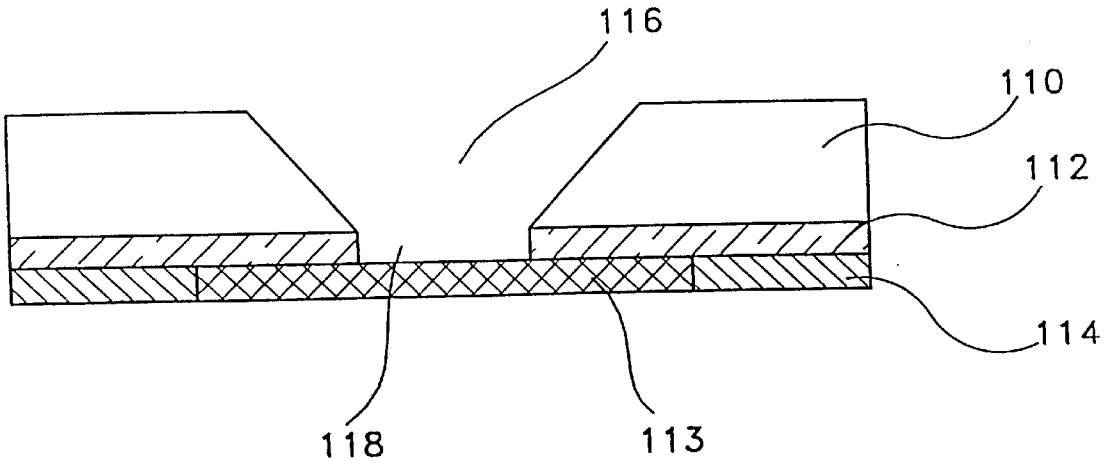
Figure 36:
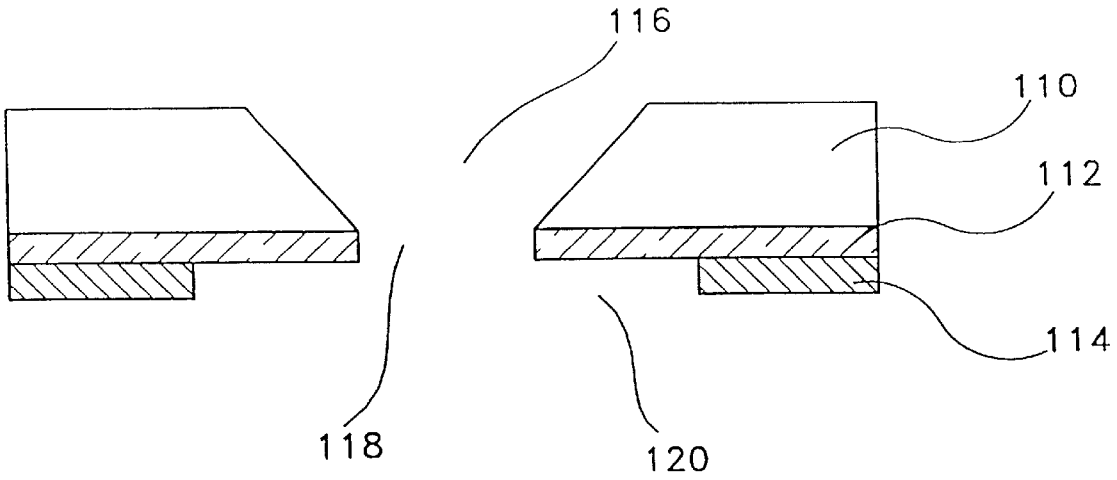
Figure 37:
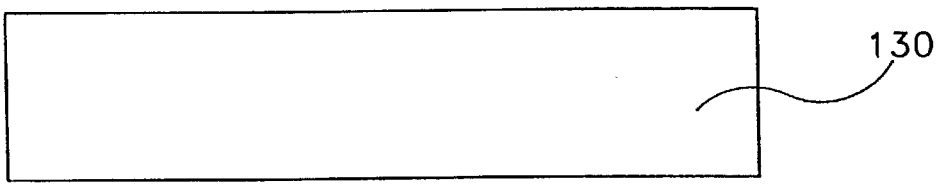
FIG. 37 through FIG. 45 are flow diagrams showing again another practice example of the present invention.
Figure 38:
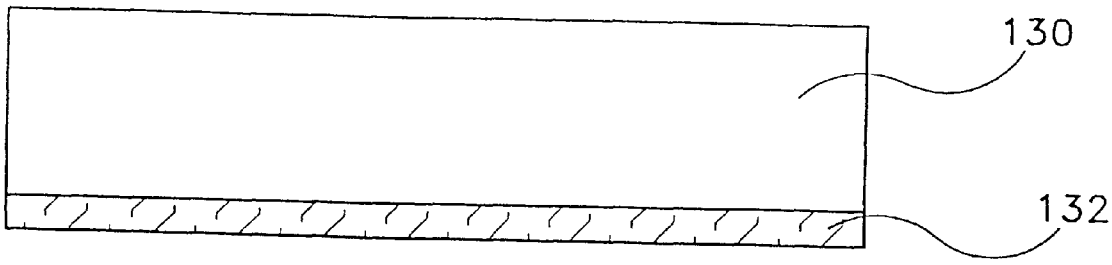
Figure 39:
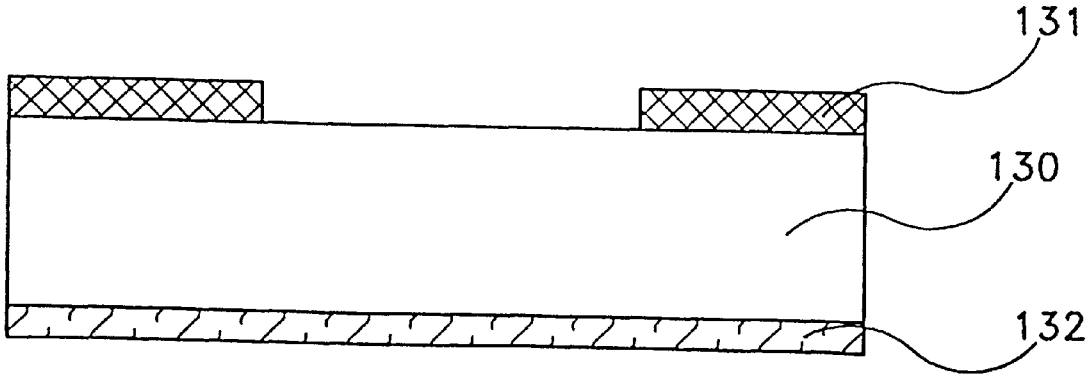
Figure 40:
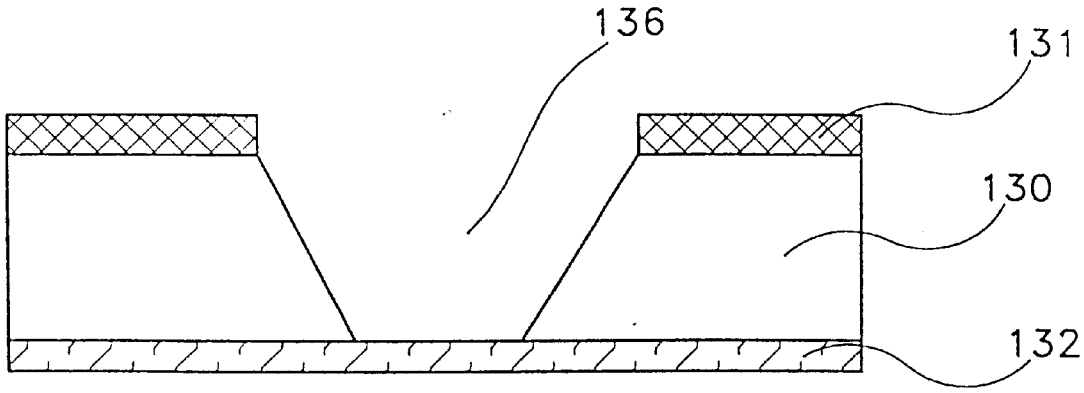
Figure 41:
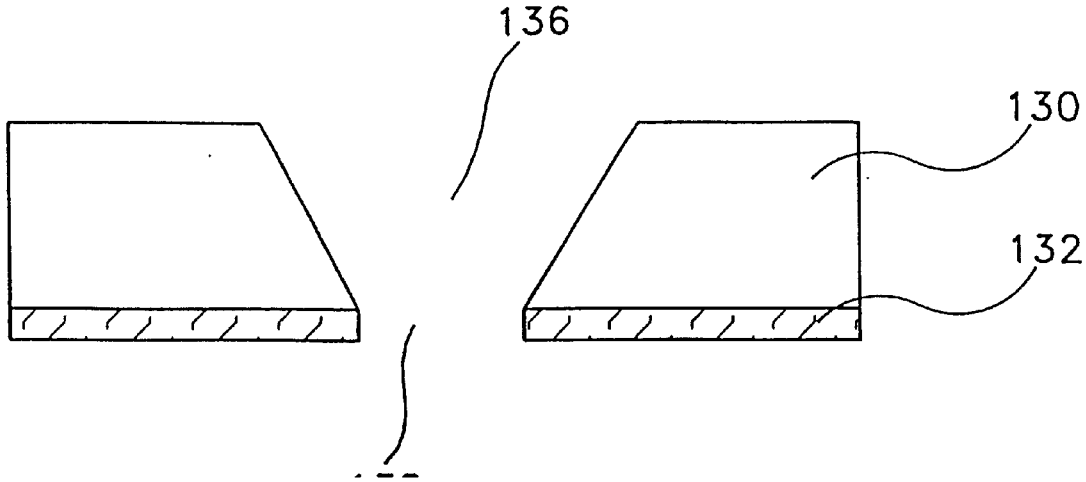
Figure 42:
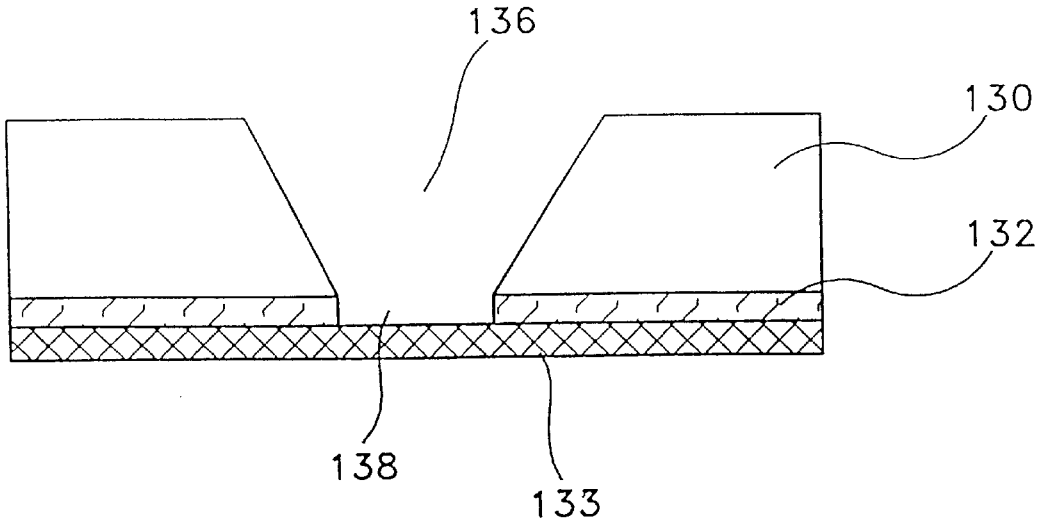
Figure 43:
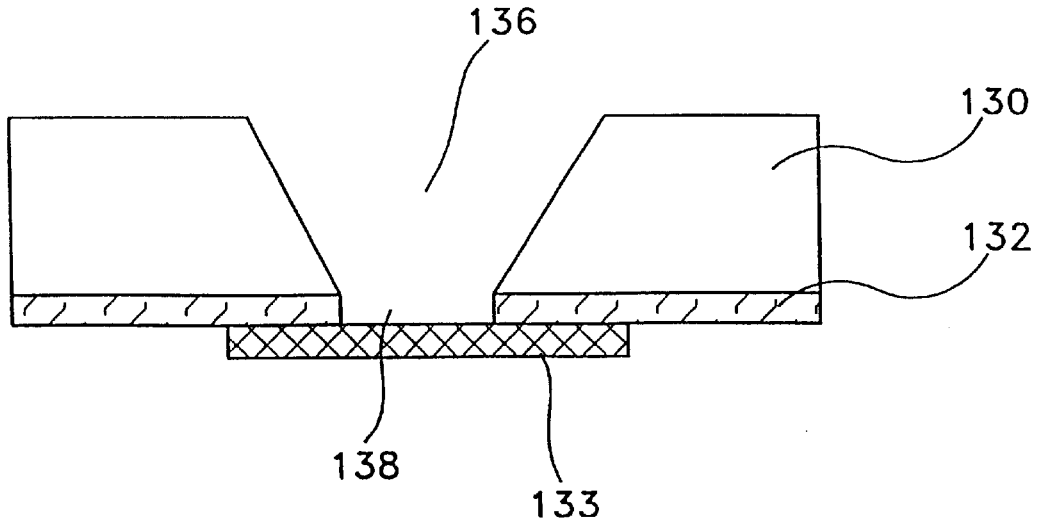
Figure 44:
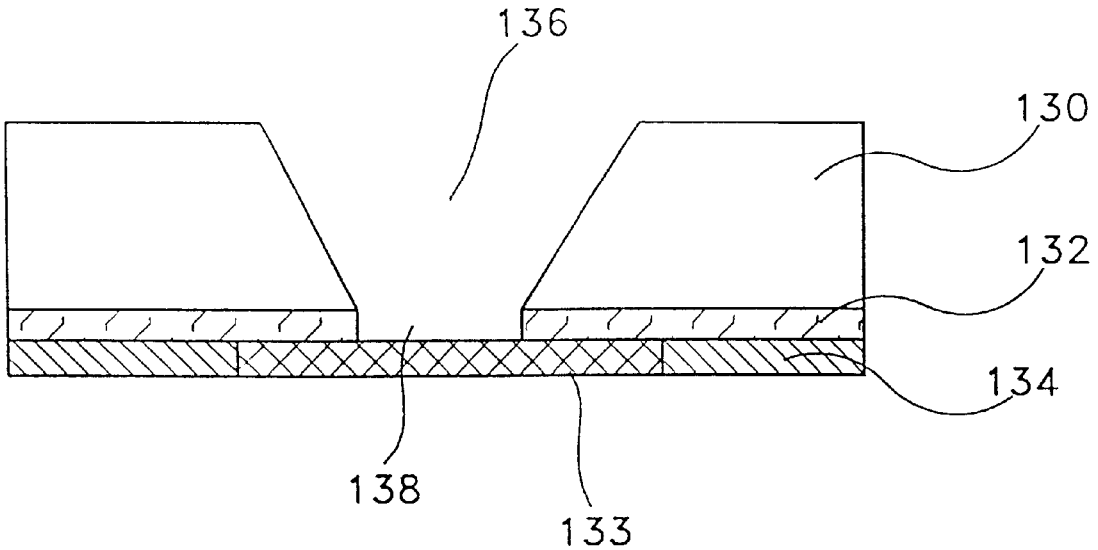
Figure 45:
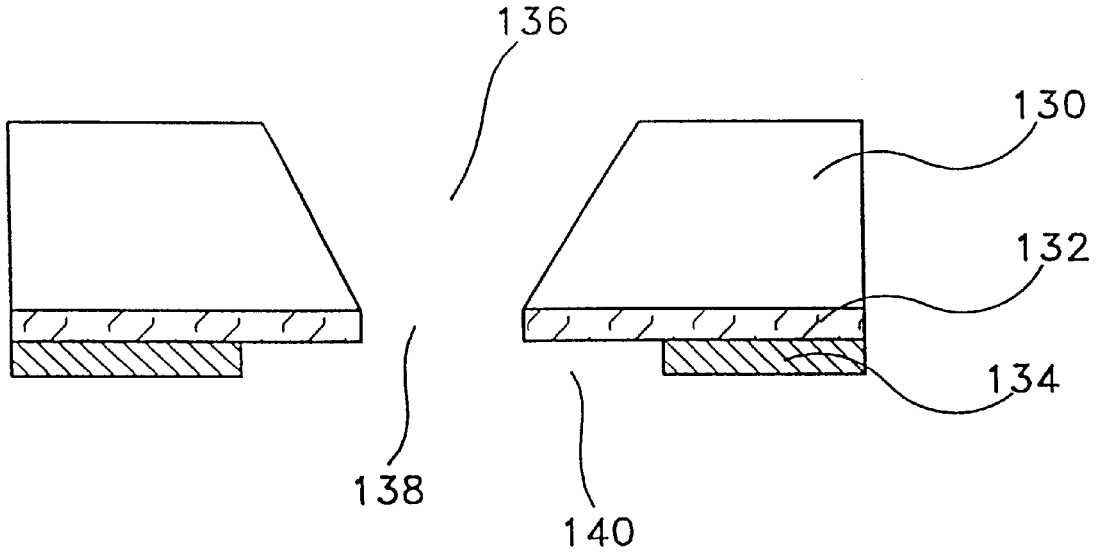
Figure 46:
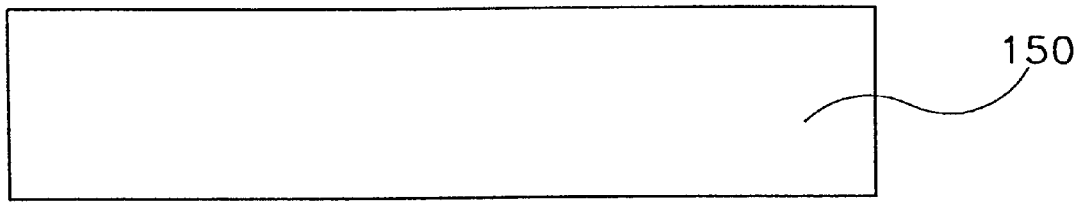
FIG. 46 through FIG. 54 are flow diagrams showing once again another practice example of the present invention.
Figure 47:
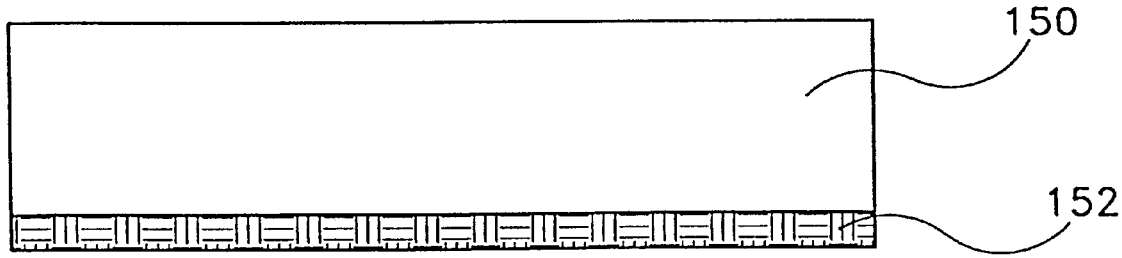
Figure 48:
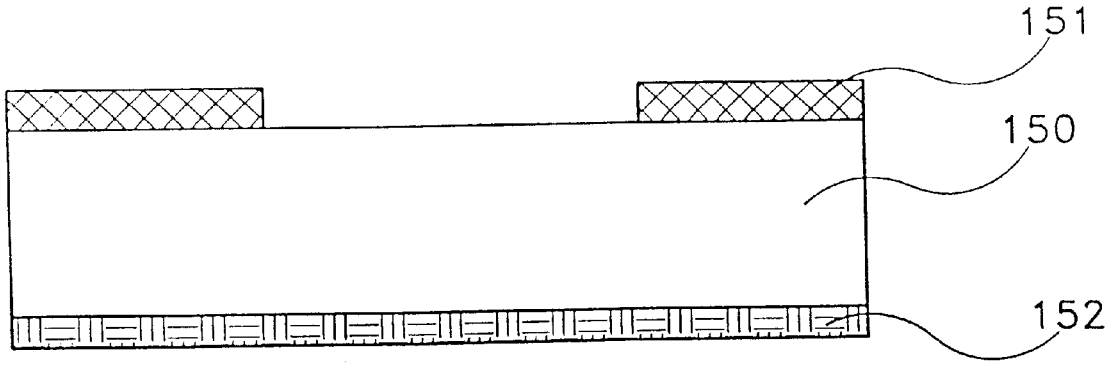
Figure 49:
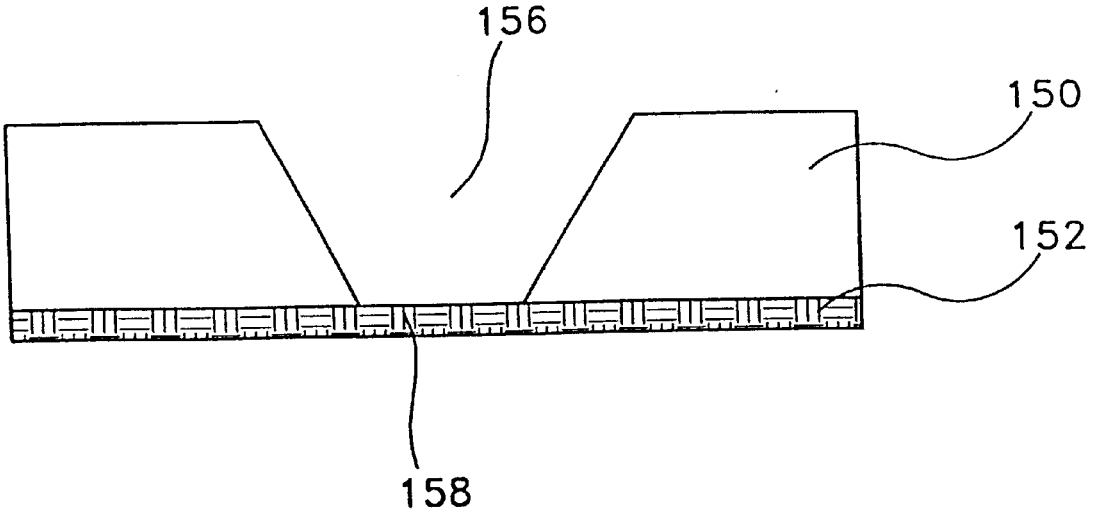
Figure 50:
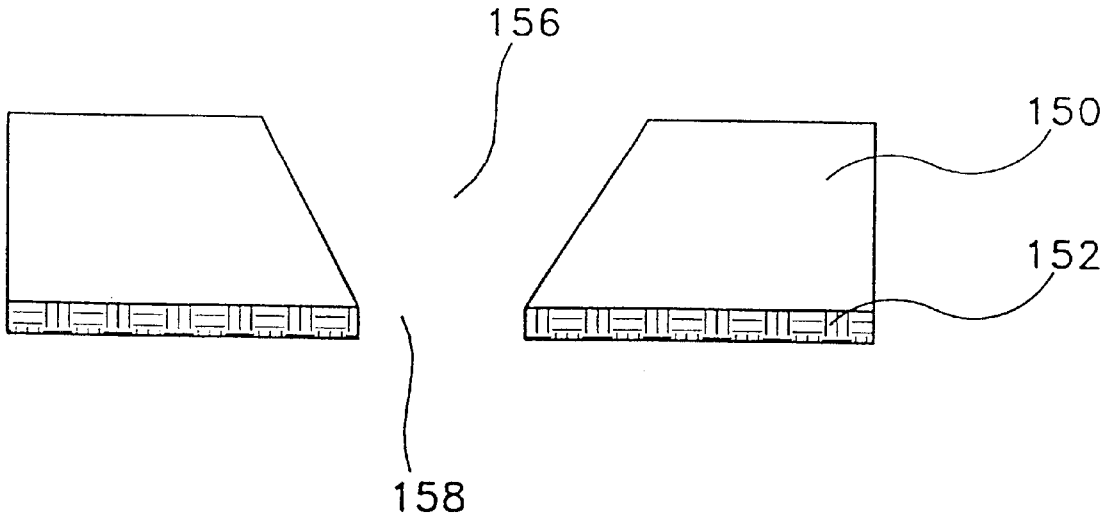
Figure 51:
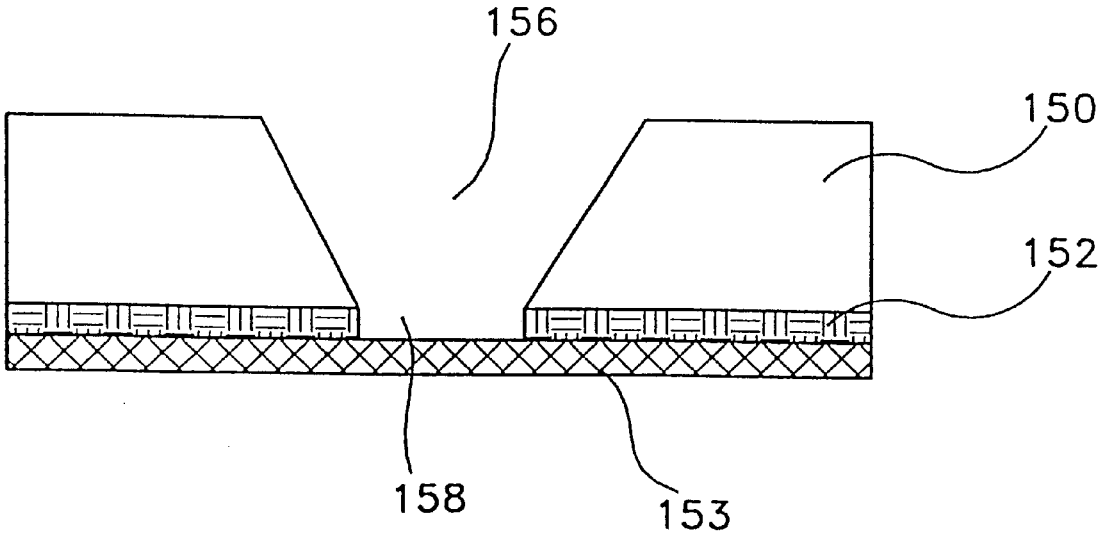
Figure 52:
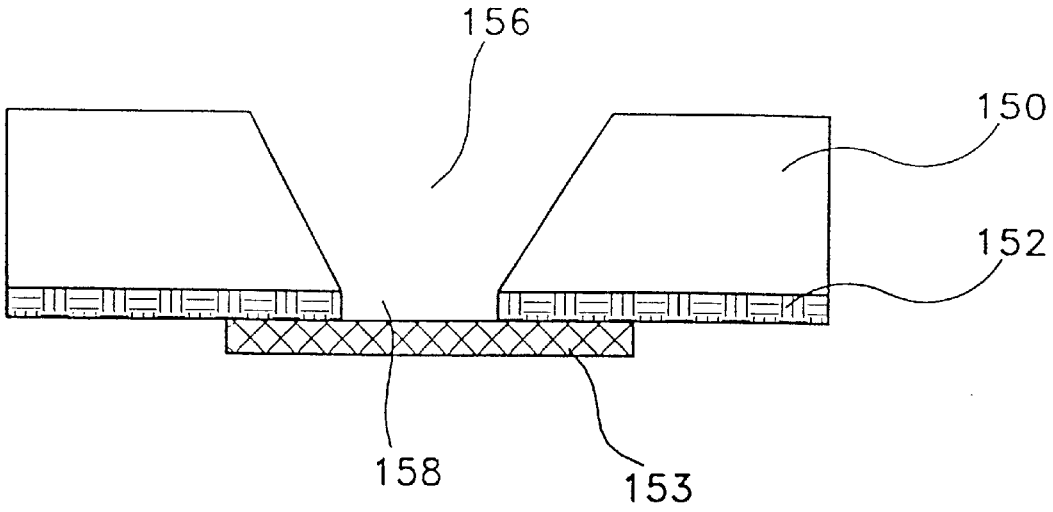
Figure 53:
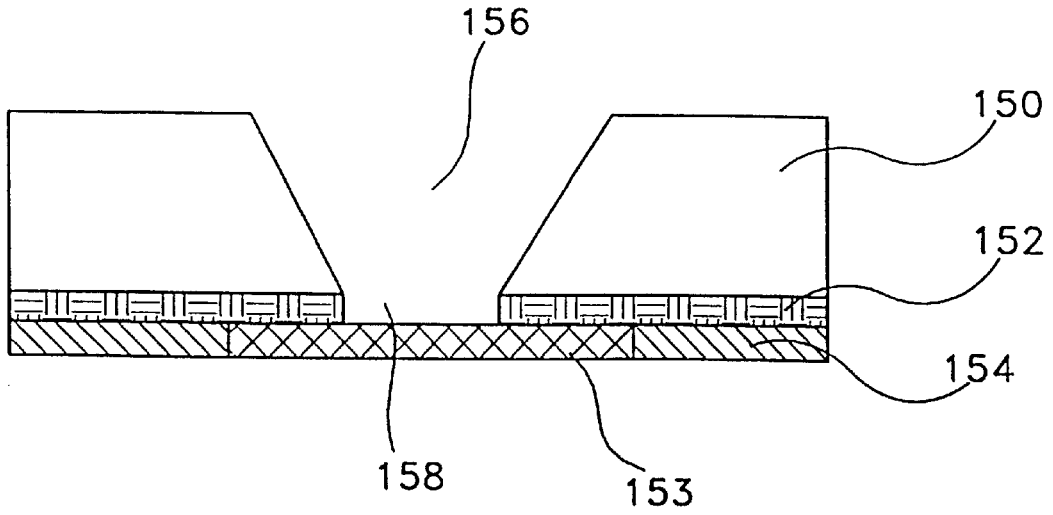
Figure 54:
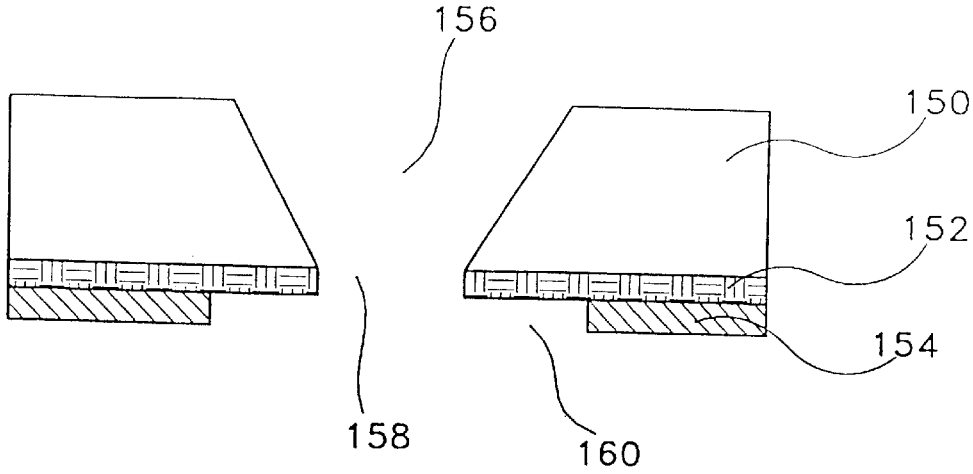
Figure 55:
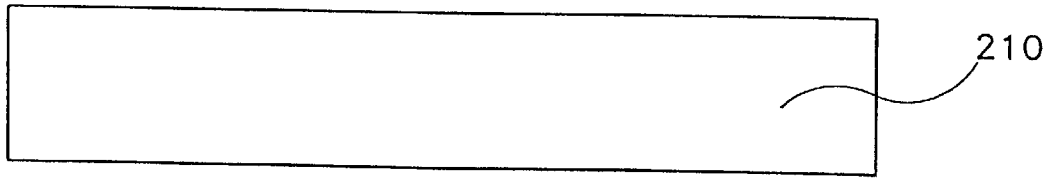
FIG. 55 through FIG. 63 are flow diagrams showing the other practice example of the present invention.
Figure 56:
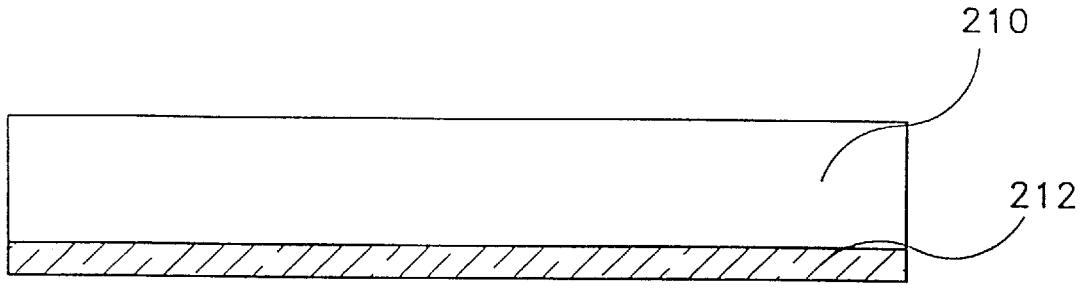
Figure 57:
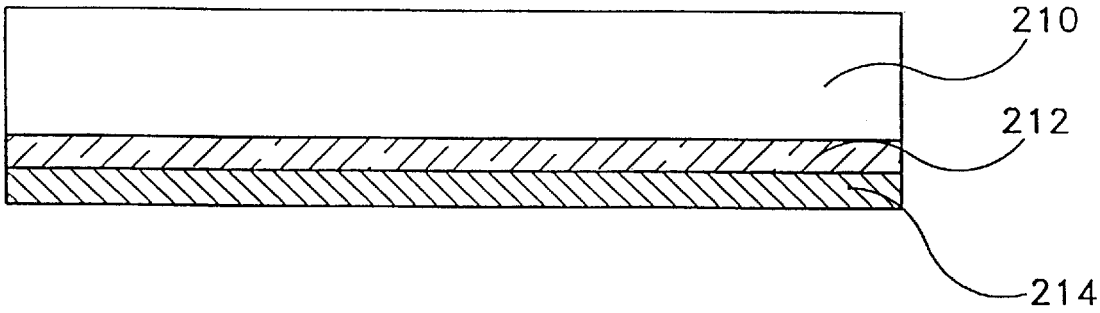
Figure 58:
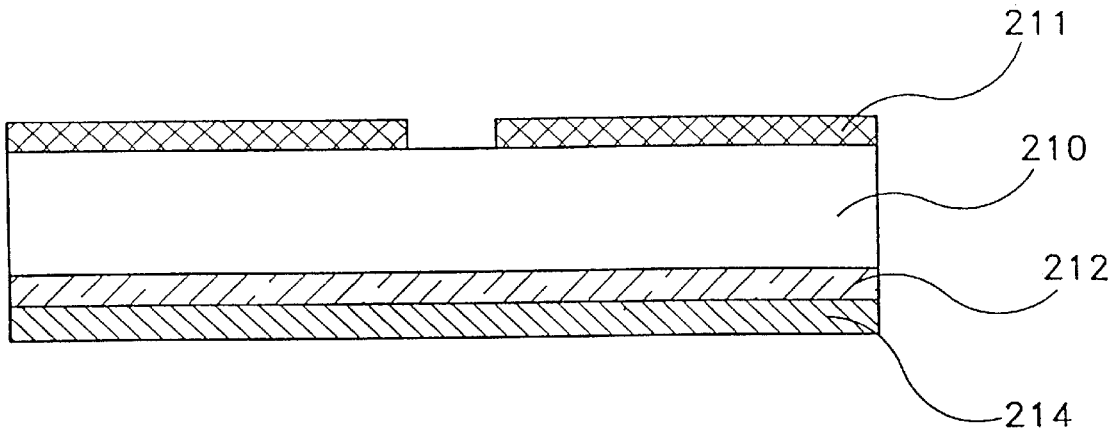

Present invention nozzle plate manufacture method can be classified into two of which the first method is explained now.

Silicon wafer is used for nozzle plate material. Silicon has property not to go bending deformation as it has high rigidity in relation to given thickness so that large area process of wafer unit can be executed.

Silicon wafer thickness may be chosen at will from 5 to 500 $\mu$m. If silicon wafer is thin, interval between nozzles can be reduced so as to be able to be highly integrated, while if silicon wafer is thick, nozzle plate rigidity is enhanced so that silicon wafer can be used choosing its thickness suitably according to wanted characteristics.

Straight pipe part layer is formed under the silicon wafer. It is preferable to form the layer 1 to 30 $\mu$m thick, particularly 5 to 10 $\mu$m thick.

This layer may be formed using one of following three methods.

First method forms doping layer by doping at silicon wafer bottom part. If it is doped after adding impurity component at silicon wafer bottom part, doped part gets electric characteristics which is different characteristics from that of upper part silicon wafer.

Second method forms polysilicon (poly-Si) layer at silicon wafer bottom part. Polysilicon layer is formed by dry process such as sputtering and vapor deposition or by wet process such as sol-gel process.

Third method forms metal layer under silicon wafer by electroplating metal. Ordinary metals may be used for metal layer material but it is preferable to use ink-resistant metal such as nickel (Ni), nickel-chromium (Ni—Cr) or nickel-cobalt-tungsten (Ni—Co—W).

Crater layer is formed under the straight pipe part layer or the etching stop layer by electroplating metal. Various metals may be used for metal that forms the crater layer while it is preferable to use ink-resistant metal such as nickel, nickel-chromium or nickel-cobalt-tungsten.

Etching stop layer may also be formed under metal layer in case where metal layer is formed for straight pipe part layer. The etching stop layer is formed by electroforming or sputtering using metal such as gold (Au), silver (Ag), palladium (Pd), platinum (Pt), chromium (Cr) or an alloy of these. It is preferable to form the crater layer of metal of different component from that of metal that is straight pipe part layer material in case where etching stop layer is not formed.

It is preferable to form the crater layer 1 to 15 $\mu$m thick, particularly 5 to 10 $\mu$m thick.

When crater layer electroplating has been finished, photoresist is coated on silicon wafer, then it is exposed to light and patterned after which nozzle slope portion is formed by wet or dry etching. Anisotropic etching liquid such as potassium hydroxide {KOH}, trimethylamine hydroxide {TMAH} is used for the etching liquid because anisotropic etching should be done on silicon wafer, and hole of sloped shape is formed at (100) crystal direction silicon wafer.

Nozzle may also be formed by repeating process of coating photoresist on silicon wafer, exposing to light, patterning, and then etching to form V-shaped groove when etching silicon wafer. Nozzle slope part is formed under silicon wafer and straight pipe part is formed upon this nozzle slope part in case where silicon wafer is etched in said method. In case where thus straight pipe part is formed upon nozzle slope part, bonding process maybe dispensed with in process of fixing to ink jet printer head body.

Straight pipe part layer is not etched when etching silicon wafer because the straight pipe part layer is different in material property from silicon wafer so that the layer may function as etching stop layer.

Straight pipe part of nozzle outlet part is formed by dry etching of straight pipe part layer after forming nozzle slope portion by etching silicon wafer according to the above methods. The dry etching may be done using facility of ICP (inductively coupled plasma) or ICP-RIE (inductively coupled plasma-reaction ion etching) etc.

If straight pipe part is formed at nozzle outlet part, frequency characteristics is improved by diminishing meniscus vibration and straightness is improved at time of ink jetting.

Crater is formed by etching after patterning crater layer by photoresist etc. after forming straight pipe part.

Nozzle plate is fabricated according to the above methods by which there are formed a nozzle having slope portion and straight pipe portion at outlet part and a crater thereunder.

Then second manufacture method of present invention nozzle plate is explained now.

Silicon wafer is used for nozzle plate material where silicon wafer thickness may be chosen at will from 5 to 500 μm.

Straight pipe part layer is formed under the silicon wafer. This layer may be formed by one of three methods as described in former method. It is preferable to form the layer 1 to 30 μm thick, particularly 5 to 0 μm thick also in this second method.

After forming the layer, photoresist is coated on silicon wafer, then it is exposed to light and patterned after which nozzle slope portion is formed by wet or dry etching Nozzle may also be formed by repeating process of coating photoresist on silicon wafer, exposing to light, patterning, and then etching to form V-shaped groove when etching silicon wafer. Nozzle slope part is formed under silicon wafer and straight pipe part is formed upon this nozzle slope part in case where silicon wafer is etched in said method. In case where thus straight pipe part is formed upon nozzle slope part, bonding process maybe dispensed with in process of fixing to ink jet printer head body.

Straight pipe part layer is not etched when etching silicon wafer also in this second manufacture method because the straight pipe part layer is different in material property from silicon wafer so that the layer may function as etching stop layer.

Straight pipe part of nozzle outlet part is formed by dry etching of straight pipe part layer after forming nozzle slope portion by etching silicon wafer according to the above methods. The dry etching methods used are same as in first manufacture method.

Photoresist layer is formed in crater layer thickness to be formed under the straight pipe part layer after etching the silicon wafer and the straight pipe part layer. Whence it is preferable to form photoresist 1 to 15 μm thick and particularly 5 to 10 μm thick. It is preferable to use dry film for photoresist which dry film is laminated to form the photoresist layer.

After patterning the formed photoresist layer, photoresist is left only at part to create crater while remainder part photoresist is removed.

Crater layer is formed under the straight pipe part layer by electroplating metal after removing photoresist. Various metals may be used for metal that forms the crater layer while it is preferable to use ink-resistant metal such as nickel, nickel-chromium or nickel-cobalt-tungsten.

Crater is formed by removing the remaining photoresist after forming the crater layer.

Nozzle plate is fabricated according to the above methods by which there are formed a nozzle having slope portion and straight pipe portion at outlet part and a crater thereunder.

Hydrophile or water repellency treatment may be performed on the side contacting the channel, the nozzle and the nozzle plate, and the portion where ink is jetted so as to enhance hydrophilia or water repellency though nozzle plate manufactured by the above methods may be used without particular hydrophile or water repellency treatment. Whence it is preferable to use method of making silicon oxide or nitride film on silicon surface or method of metal vapor deposition on silicon surface for hydrophile treatment. And for water repellency treatment it is preferable to use method of doping boron (B) on silicon surface, method of chemically reducing silicon surface (Si—H), method of treating silicon surface with HF etc., method of film coating of water-repellent polymer after metallization on silicon surface, etc. Electric conductive metal is vapor deposited on silicon surface for metallization where it is preferable to use nickel (Ni), nickel-vanadium (Ni—V) or nickel-chromium (Ni—Cr) among electric conductive metals. PTFE (polytetrafluoroethylene) or Teflon is used for water-repellent polymer where it is preferable to use method of electroplating, spin coating, vapor deposition etc. for polymer film coating.

Nozzle part material selection range width may be diversified in present invention as explained above because nozzle plate is fabricated using silicon wafer. And because process for large area of wafer unit can be easily executed, multinozzle production yield percentage is high, high precision batch process is facile, and so the methods of present invention can be easily applied to mass production process.

And surface characteristics of ink jet part and channel can be easily controlled because hydrophile or water repellent treatment on nozzle plate surface contacting the ink can be done by simple process.

And freedom degree is high in designing the straight pipe part that has been formed at nozzle outlet part to improve ink jet performance to improve print performance and the crater that has been formed under nozzle plate to protect nozzle.

Now present invention practice examples are explained referring to drawing. But the following application examples are only illustrations of this invention and do not confine extent of this invention.

FIG. 1 through FIG. 9 show a present invention nozzle plate manufacture method practice example.

Firstly doping layer 12 that is to be straight pipe part layer is formed under silicon wafer 10 by doping impurity component. Crater layer 14 is formed by electroplating metal under doping layer 12 that is to be straight pipe part layer.

After crater layer 14 is formed, silicon wafer 10 is patterned and then etched anisotropically so as to form nozzle slope part 16 at silicon wafer 10. Whence doping layer 12 can play role of etching stop layer because its material property is different from that of silicon wafer 10.

After etching silicon wafer 10, doping layer 12 is dry etched so that straight pipe part 18 of nozzle outlet part is formed at doping layer 12. Then crater layer 14 is patterned and etched so as to form crater 20 at crater layer 14 so that nozzle plate is completed.

FIG. 10 through FIG. 18 show other present invention nozzle plate manufacture method practice example.

Firstly polysilicon layer 32 that is to be straight pipe part layer is formed under silicon wafer 30. Crater layer 34 is formed by electroplating metal under polysilicon layer 32 that is to be straight pipe part layer.

After crater layer 34 is formed, silicon wafer 30 is patterned and then etched anisotropically so as to form nozzle slope part 36 at silicon wafer 30. Whence polysilicon layer 32 can play role of etching stop layer because its material property is different from that of silicon wafer 30.

After etching silicon wafer 30, polysilicon layer 32 is dry etched so that straight pipe part 38 of nozzle outlet part is formed at polysilicon layer 32. Then crater layer 34 is patterned and etched so as to form crater 40 at crater layer 34 so that nozzle plate is completed.

FIG. 19 through FIG. 27 show another present invention nozzle plate manufacture method practice example.

Firstly metal layer 52 that is to be straight pipe part layer is formed under silicon wafer 50. Crater layer 54 is formed by electroplating metal under metal layer 52 that is to be straight pipe part layer.

After crater layer 54 is formed, silicon wafer 50 is patterned and then etched anisotropically so as to form nozzle slope part 56 at silicon wafer 50. Whence metal layer 52 can play role of etching stop layer because its material property is different from that of silicon wafer 50.

After etching silicon wafer 50, metal layer 52 is dry etched so that straight pipe part 58 of nozzle outlet part is formed at metal layer 52. Then crater layer 54 is patterned and etched so as to form crater 60 at crater layer 54 so that nozzle plate is completed.

FIG. 28 through FIG. 36 show more another present invention nozzle plate manufacture method practice example.

Firstly doping layer 112 that is to be straight pipe part layer is formed under silicon wafer 110 by doping impurity component. After doping layer 112 is formed, silicon wafer 110 is patterned and then etched anisotropically so as to form nozzle slope part 116 at silicon wafer 110. Whence doping layer 112 can play role of etching stop layer because its material property is different from that of silicon wafer 110.

After etching silicon wafer 110, doping layer 112 is dry etched so that straight pipe part 118 of nozzle outlet part is formed at doping layer 112.

Then photoresist layer 113 is formed under doping layer 112, then photoresist layer 113 is patterned so that photoresist be left only at part to create crater but be removed from remainder part. Crater layer 114 is formed under doping layer 112 that is to be straight pipe part layer by electroplating metal after removing photoresist. Crater 120 is formed by removing the remaining photoresist 113 after forming crater layer 114 so that nozzle plate is completed.

FIG. 37 through FIG. 45 show again another present invention nozzle plate manufacture method practice example.

Firstly polysilicon layer 132 that is to be straight pipe part layer is formed under silicon wafer 130. After polysilicon layer 132 is formed, silicon wafer 130 is patterned and then etched anisotropically so as to form nozzle slope part 136 at silicon wafer 130. Whence polysilicon layer 132 can play role of etching stop layer because its material property is different from that of silicon wafer 130.

After etching silicon wafer 130, polysilicon layer 132 is dry etched so that straight pipe part 138 of nozzle outlet part is formed at polysilicon layer 132. Then photoresist layer 133 is formed under polysilicon layer 132, then photoresist layer 133 is patterned so that photoresist be left only at part to create crater but be removed from remainder part.

Crater layer 134 is formed under polysilicon layer 132 that is to be straight pipe part layer by electroplating metal after removing photoresist. Crater 140 is formed by removing the remaining photoresist 133 after forming crater layer 134 so that nozzle plate is completed.

FIG. 46 through FIG. 54 show once again another present invention nozzle plate manufacture method practice example.

Firstly metal layer 152 that is to be straight pipe part layer is formed under silicon wafer 150. After metal layer 152 is formed, silicon wafer 150 is patterned and then etched anisotropically so as to form nozzle slope part 156 at silicon wafer 150. Whence metal layer 152 can play role of etching stop layer because its material property is different from that of silicon wafer 150.

After etching silicon wafer 150, metal layer 152 is dry etched so that straight pipe part 158 of nozzle outlet part is formed at metal layer 152.

Then photoresist layer 153 is formed under metal layer 152, then photoresist layer 153 is patterned so that photoresist be left only at part to create crater but be removed from remainder part.

Crater layer 154 is formed under metal layer 152 that is to be straight pipe part layer by electroplating metal after removing photoresist. Crater 160 is formed by removing the remaining photoresist 153 after forming crater layer 154 so that nozzle plate is completed.

FIG. 55 through FIG. 63 show the other present invention nozzle plate manufacture method practice example.

Firstly doping layer 212 that is to be straight pipe part layer is formed under silicon wafer 210 by doping impurity component. Crater layer 214 is formed by electroplating metal under doping layer 212 that is to be straight pipe part layer.

Figure 59:
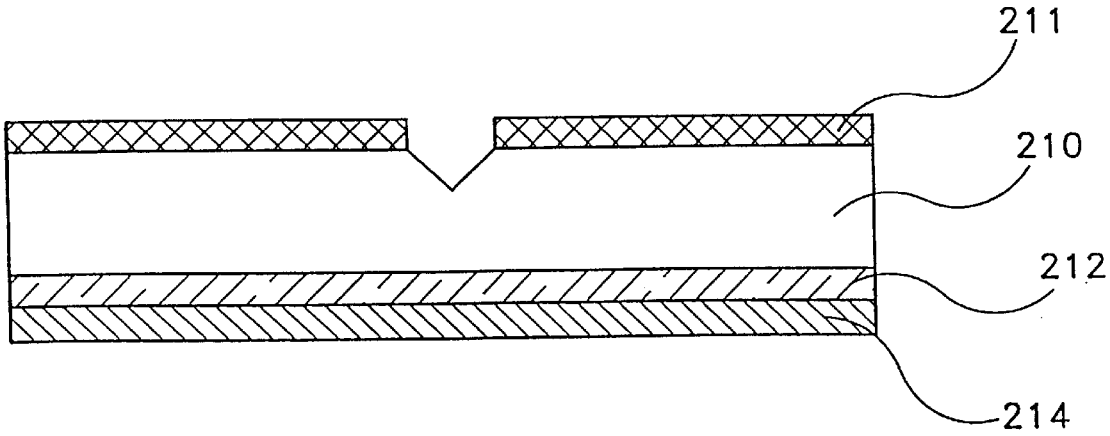
Figure 60:
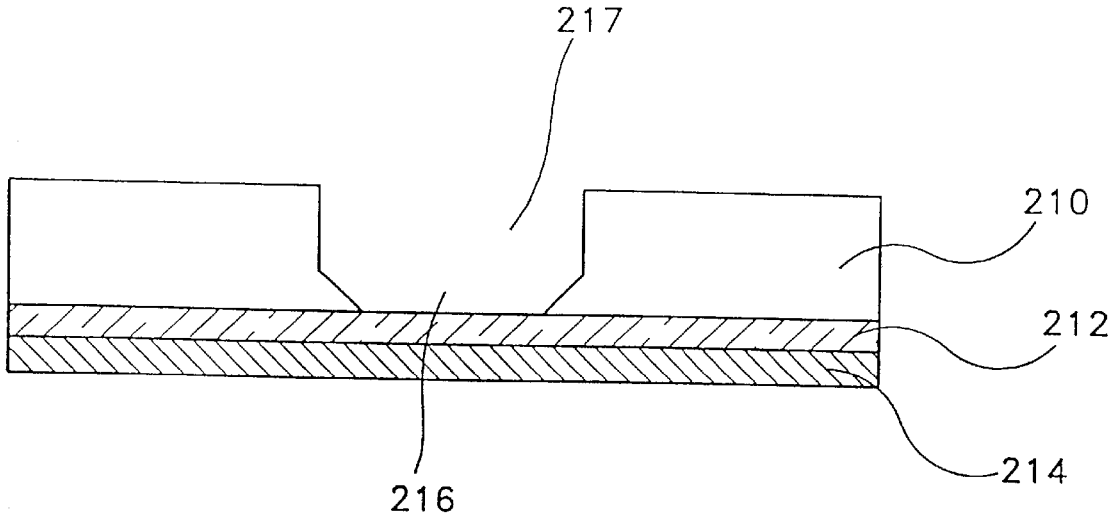
Figure 61:
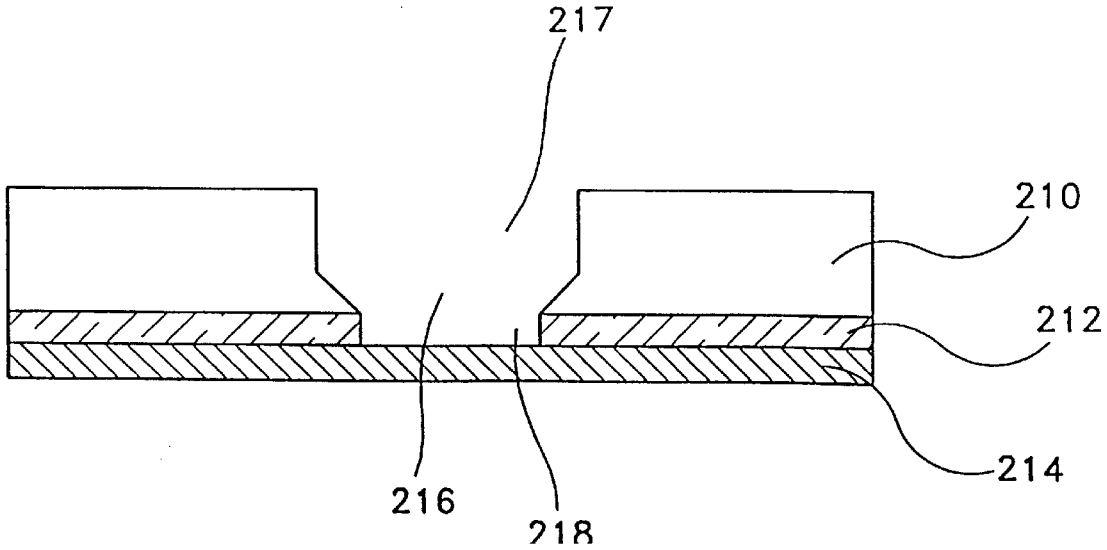
Figure 62:
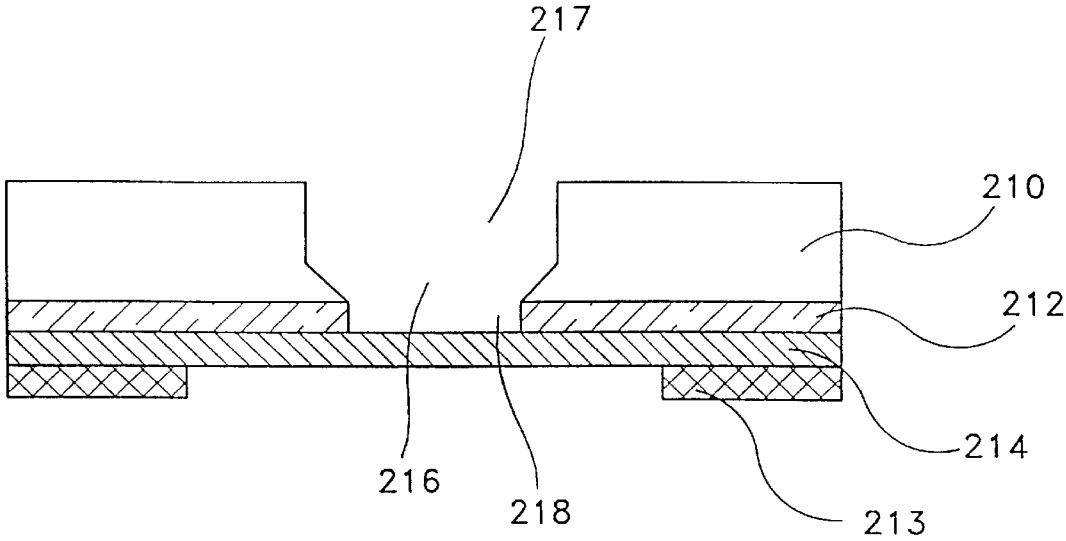
Figure 63:
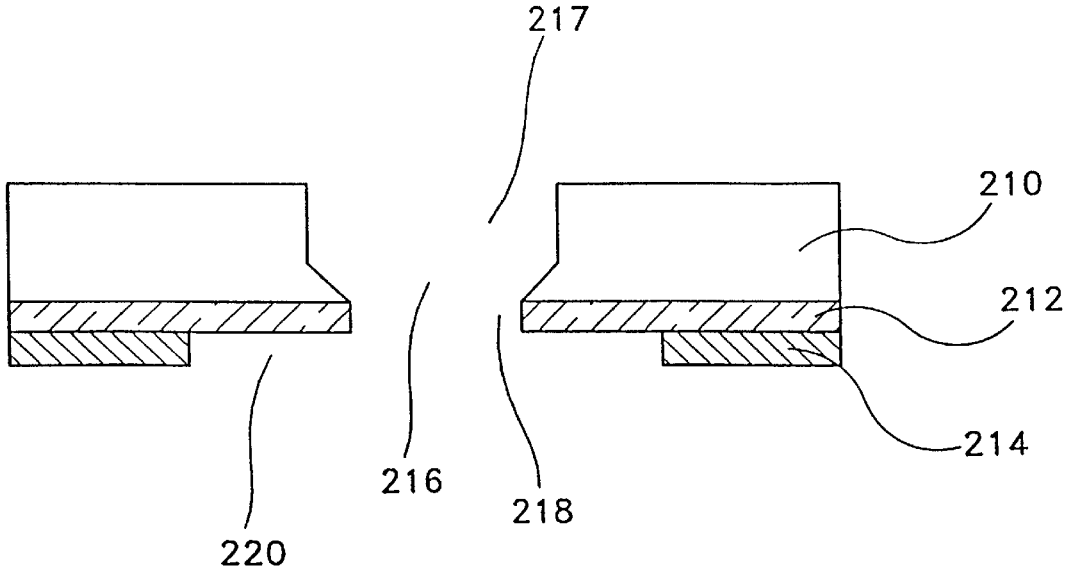

After crater layer 214 is formed, silicon wafer 210 is patterned and then etched so as to form V-shaped groove as shown on FIG. 59. Nozzle slope part 216 and straight pipe part 217 to be formed above nozzle slope part 216 are formed at silicon wafer 210 by repeating said step.

After forming thus nozzle slope part 216 and straight pipe part 217, doping layer 212 is dry etched so that straight pipe part 218 of nozzle outlet part is formed at doping layer 212. Then crater layer 214 is patterned and etched so as to form crater 220 at crater layer 214 so that nozzle plate is completed.

What is claimed is:

1. A manufacturing method of nozzle plate comprising the steps of providing a silicon wafer;

forming a straight pipe part layer under said silicon wafer by doping impurity component;

forming a crater layer under said straight pipe part layer by electroplating a metal;

forming a nozzle slope part by anisotropic etching after patterning said silicon wafer;

forming a straight pipe part of nozzle outlet part at said straight pipe part layer by dry etching of said straight pipe part layer; and forming a crater at the crater layer by etching after patterning said crater layer.

2. The method in claim 1, wherein said straight pipe part layer is 1 to 30 $\mu$m thick.

3. The method in claim 1, wherein metal to make said crater layer is nickel (Ni), nickel-chromium (Ni—Cr) or nickel-cobalt-tungsten (Ni—Co—W).

4. The method in claim 1, wherein said crater layer is 1 to 15 $\mu$m thick.

5. The method in claim 1, wherein the etching of said silicon wafer to make said nozzle slope part is by repeating step where silicon wafer is patterned and then etched to make V-shaped groove.

6. The method in claim 1, wherein the method further comprises a step of hydrophile treatment at the part of contacting the ink in said finished nozzle plate.

7. The method in claim 6, wherein a method for said hydrophile treatment is a method of making silicon oxide or nitride film or a method of metal vapor deposition on silicon surface.

8. The method in claim 1, wherein the method further comprises a step of water repellency treatment at the part of contacting the ink in said finished nozzle plate.

9. The method in claim 8, wherein a method for said water repellency treatment is a method of doping boron on silicon surface, a method of chemically reducing silicon surface, a method of treating silicon surface with HF, or a method of film coating of water-repellent polymer after metallization on silicon surface.

10. A manufacturing method of nozzle plate comprising the steps of:

providing a silicon wafer;

forming a straight pipe part layer made of polysilicon under said silicon wafer;

forming a crater layer under said straight pipe part layer by electroplating a metal;

forming a nozzle slope part by anisotropic etching after patterning said silicon wafer;

forming a straight pipe part of nozzle outlet part at said straight pipe part layer by dry etching of said straight pipe part layer; and forming a crater at said crater layer by etching after patterning said crater layer.

11. The method in claim 10, wherein said straight pipe part layer is 1 to 30 $\mu$m thick.

12. The method in claim 10, wherein said metal to make said crater layer is nickel (Ni), nickel-chromium (Ni—Cr) or nickel-cobalt-tungsten (Ni—Co—W).

13. The method in claim 10, wherein said crater layer is 1 to 15 $\mu$m thick.

14. The method in claim 10, wherein the etching of silicon wafer to make said nozzle slope part is by repeating step where said silicon wafer is patterned and then etched to make V-shaped groove.

15. The method in claim 10, wherein the method further comprises a step of hydrophile treatment at the part of contacting the ink in said finished nozzle plate.

16. The method in claim 15, wherein a method for said hydrophile treatment is a method of making silicon oxide or nitride film or a method of metal vapor deposition on silicon surface.

17. The method in claim 10, wherein the method further comprises a step of water repellency treatment at the part of contacting the ink in said finished nozzle plate.

18. The method in claim 17, where in a method for said water repellency treatment is a method of doping boron on silicon surface, a method of chemically reducing silicon surface, a method of treating silicon surface with HF, or a method of film coating of water-repellent polymer after metallization on silicon surface.

19. A manufacturing method of nozzle plate comprising the steps of:

providing a silicon wafer;

forming a straight pipe part layer under said silicon wafer by electroplating a metal;

forming a crater layer under said straight pipe part layer by electroplating a metal;

forming a nozzle slope part by anisotropic etching after patterning said silicon wafer;

forming a straight pipe part of nozzle outlet part at said straight pipe part layer by dry etching of said straight pipe part layer; and forming a crater at the crater layer by etching after patterning said crater layer.

20. The method in claim 19, wherein the method further comprises a step of making an etching stop layer between steps of making said straight pipe part layer and of making said crater layer.

21. The method in claim 20, wherein said etching stop layer is made of gold (Au), silver (Ag), palladium (Pd), platinum (Pt), chromium (Cr) or an alloy of these.

22. The method in claim 19, wherein metal to make said straight pipe part layer is nickel (Ni), nickel-chromium (Ni—Cr) or nickel-cobalt-tungsten (Ni—Co—W).

23. The method in claim 19, wherein said straight pipe part layer is 1 to 30 $\mu$m thick.

24. The method in claim 19, wherein metal to make said crater layer is nickel (Ni), nickel-chromium (Ni—Cr) or nickel-cobalt-tungsten (Ni—Co—W).

25. The method in claim 19, wherein said crater layer is 1 to 15 $\mu$m thick.

26. The method in claim 19, wherein said straight pipe part layer and said crater layer are made of metals of mutually different components for each layer.

27. The method in claim 19, wherein the etching of said silicon wafer to make said nozzle slope part is by repeating step where silicon wafer is patterned and then etched to make V-shaped groove.

28. The method in claim 19, wherein the method further comprises a step of hydrophile treatment at the part of contacting the ink in said finished nozzle plate.

29. The method in claim 28, wherein a method for said hydrophile treatment is a method of making silicon oxide or nitride film or a method of metal vapor deposition on silicon surface.

30. The method in claim 19, wherein the method further comprises a step of water repellency treatment at the part of contacting the ink in said finished nozzle plate.

31. The method in claim 30, wherein a method for said water repellency treatment is a method of doping boron on silicon surface, a method of chemically reducing silicon surface, a method of treating silicon surface with HF, or a method of film coating of water-repellent polymer after metallization on silicon surface.

32. A manufacturing method of nozzle plate comprising the steps of:

providing a silicon wafer;

forming a straight pipe part layer under said the silicon wafer by doping impurity component;

forming a nozzle slope part by anisotropic etching after patterning said silicon wafer;

forming a straight pipe part of nozzle outlet part at said straight pipe part layer by dry etching of said straight pipe part layer;

forming a photoresist layer under said straight pipe part layer;

leaving the photoresist only at crater part by patterning said photoresist layer;

forming a crater layer by electroplating a metal under said straight pipe part layer; and forming a crater by removing said photoresist.

33. The method in claim 32, wherein said straight pipe part layer is 1 to 30 $\mu$m thick.

34. The method in claim 32, wherein metal to make said crater layer is nickel (Ni), nickel-chromium (Ni—Cr) or nickel-cobalt-tungsten (Ni—Co—W).

35. The method in claim 32, wherein said crater layer is 1 to 15 $\mu$m thick.

36. The method in claim 32, wherein the etching of said silicon wafer to make said nozzle slope part is by repeating step where said silicon wafer is patterned and then etched to make V-shaped groove.

37. The method in claim 32, wherein the method further comprises a step of hydrophile treatment at the part of contacting the ink in said finished nozzle plate.

38. The method in claim 37, wherein a method for said hydrophile treatment is a method of making silicon oxide or nitride film or a method of metal vapor deposition on silicon surface.

39. The method in claim 32, wherein the method further comprises a step of water repellency treatment at the part of contacting the ink in said finished nozzle plate.

40. The method in claim 39, wherein a method for said water repellency treatment is a method of doping boron on silicon surface, a method of chemically reducing silicon surface, a method of treating silicon surface with HF, or a method of film coating of water-repellent polymer after metallization on silicon surface.

41. A manufacturing method of nozzle plate comprising the steps of:

providing a silicon wafer;

forming a straight pipe part layer made of polysilicon under said silicon wafer;

forming a nozzle slope part by anisotropic etching after patterning said silicon wafer;

forming a straight pipe part of nozzle outlet part at said straight pipe part layer by dry etching of said straight pipe part layer;

forming a photoresist layer under said straight pipe part layer;

leaving said photoresist only at crater part by patterning said photoresist layer;

forming a crater layer by electroplating a metal under said straight pipe part layer; and forming a crater by removing said photoresist.

42. The method in claim 41, wherein said straight pipe part layer is 1 to 30 $\mu$m thick.

43. The method in claim 41, wherein metal to make said crater layer is nickel (Ni), nickel-chromium (Ni—Cr) or nickel-cobalt-tungsten (Ni—Co—W).

44. The method in claim 41, wherein said crater layer is 1 to 15 $\mu$m thick.

45. The method in claim 41, wherein the etching of silicon wafer to make said nozzle slope part is by repeating step where said silicon wafer is patterned and then etched to make V-shaped groove.

46. The method in claim 41, wherein the method further comprises a step of hydrophile treatment at the part of contacting the ink in said finished nozzle plate.

47. The method in claim 46, wherein a method for said hydrophile treatment is a method of making silicon oxide or nitride film or a method of metal vapor deposition on silicon surface.

48. The method in claim 41, wherein the method further comprises a step of water repellency treatment at the part of contacting the ink in said finished nozzle plate.

49. The method in claim 48, where in a method for said water repellency treatment is a method of doping boron on silicon surface, a method of chemically reducing silicon surface, a method of treating silicon surface with HF, or a method of film coating of water-repellent polymer after metallization on silicon surface.

50. A manufacturing method of nozzle plate comprising the steps of:

providing a silicon wafer;

forming a straight pipe part layer formed by electroplating a metal under said silicon wafer;

forming a nozzle slope part by anisotropic etching after patterning said silicon wafer;

forming a straight pipe part of nozzle outlet part at said straight pipe part layer by dry etching of said straight pipe part layer;

forming a photoresist layer under said straight pipe part layer;

leaving said photoresist only at crater part by patterning said photoresist layer;

forming a crater layer by electroplating a metal under said straight pipe part layer; and forming a crater by removing said photoresist.

51. The method in claim 50, wherein metal to make said straight pipe part layer is nickel (Ni), nickel-chromium (Ni—Cr) or nickel-cobalt-tungsten (Ni—Co—W).

52. The method in claim 50, wherein said straight pipe part layer is 1 to 30 $\mu$m thick.

53. The method in claim 50, wherein metal to make said crater layer is nickel (Ni), nickel-chromium (Ni—Cr) or nickel-cobalt-tungsten (Ni—Co—W).

54. The method in claim 50, wherein said crater layer is 1 to 15 $\mu$m thick.

55. The method in claim 50, wherein the etching of silicon wafer to make said nozzle slope part is by repeating step where said silicon wafer is patterned and then etched to make V-shaped groove.

56. The method in claim 50, wherein the method further comprises a step of hydrophile treatment at the part of contacting the ink in said finished nozzle plate.

57. The method in claim 56, wherein a method for said hydrophile treatment is a method of making silicon oxide or nitride film or a method of metal vapor deposition on silicon surface.

58. The method in claim 50, wherein the method further comprises a step of water repellency treatment at the part of contacting the ink in said finished nozzle plate.

59. The method in claim 58, wherein a method for said water repellency treatment is a method of doping boron on silicon surface, a method of chemically reducing silicon surface, a method of treating silicon surface with HF, or a method of film coating of water-repellent polymer after metallization on silicon surface.

* * * * *